US006705717B1

(12) United States Patent
Fujita et al.

(10) Patent No.: US 6,705,717 B1
(45) Date of Patent: Mar. 16, 2004

(54) INK-JET PRINTER AND PRINTING SYSTEM CAPABLE OF PRINTING ON CLOTHES AND PAPERS, INK TO BE USED IN THE SYSTEM AND PRODUCTION METHOD FOR PRODUCING ARTICLE WITH EMPLOYING THE SYSTEM

(75) Inventors: Miyuki Fujita, Tokyo (JP); Masahiro Haruta, Tokyo (JP); Shoji Koike, Yokohama (JP); Hiromitsu Hirabayashi, Yokohama (JP); Nobuyuki Kuwabara, Kawasaki (JP); Yuji Akiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/314,946

(22) Filed: Sep. 29, 1994

(30) Foreign Application Priority Data

Sep. 30, 1993 (JP) ..... 5-245722
Jul. 29, 1994 (JP) ..... 6-179205

(51) Int. Cl.[7] ..... B41J 3/407
(52) U.S. Cl. ..... 347/106; 347/15; 347/100
(58) Field of Search ..... 347/5, 16, 15, 347/43, 105, 106, 95, 96, 100

(56) References Cited

U.S. PATENT DOCUMENTS

| | | | | | |
|---|---|---|---|---|---|
| 4,313,124 | A | | 1/1982 | Hara | 346/140 R |
| 4,345,262 | A | | 8/1982 | Shirato et al. | 346/140 R |
| 4,459,600 | A | | 7/1984 | Sato et al. | 346/140 R |
| 4,463,359 | A | | 7/1984 | Ayata et al. | 346/1.1 |
| 4,523,202 | A | * | 6/1985 | Gamblin | 347/106 X |
| 4,558,333 | A | | 12/1985 | Sugitani et al. | 346/140 R |
| 4,608,577 | A | | 8/1986 | Hori | 346/140 R |
| 4,617,580 | A | * | 10/1986 | Miyakawa | 346/136 |
| 4,723,129 | A | | 2/1988 | Endo et al. | 346/1.1 |
| 4,740,796 | A | | 4/1988 | Endo et al. | 346/1.1 |
| 5,142,374 | A | | 8/1992 | Tajika et al. | 358/298 |
| 5,500,661 | A | * | 3/1996 | Matsubara et al. | 347/41 |
| 5,552,811 | A | * | 9/1996 | Kurata et al. | 347/28 |
| 5,594,478 | A | * | 1/1997 | Matsubara et al. | 347/41 |

FOREIGN PATENT DOCUMENTS

| | | | | |
|---|---|---|---|---|
| EP | 0317140 | | 5/1989 | |
| EP | 0376346 | | 7/1990 | |
| EP | 0526205 | | 2/1993 | |
| EP | 0526233 | | 2/1993 | |
| EP | 558236 | * | 9/1993 | |
| EP | 0558236 | | 9/1993 | |
| EP | 0 560 562 | | 9/1993 | |
| EP | 0624682 | | 11/1994 | |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 61-55277 | | 3/1986 | |
| JP | 61-75870 | | 4/1986 | |
| JP | 62-53492 | | 3/1987 | |
| JP | 3-28727 | * | 6/1989 | 347/106 |
| JP | 2-61183 | | 3/1990 | |
| JP | 3-142251 | | 6/1991 | |
| JP | 3-146354 | | 6/1991 | |
| JP | 3-221456 | | 9/1991 | |
| JP | 4-4155 | | 1/1992 | |
| JP | 4-249177 | | 9/1992 | |
| JP | 5-179576 | | 7/1993 | |

(List continued on next page.)

*Primary Examiner*—Craig Hallacher
(74) *Attorney, Agent, or Firm*—Fitzpatrick, Cella, Harper & Scinto

(57) ABSTRACT

An ink-jet printing apparatus is constructed to have one or more kinds of cloth printing modes and to select the cloth printing mode. In the cloth printing mode, at least one of printing condition is differentiated from the printing condition for other media. Also, by permitting various setting for the ink ejection amount and ejection method in the cloth printing mode, fine and precise textile printing can be performed by normal ink-jet printer in personal use.

33 Claims, 25 Drawing Sheets

U.S. PATENT DOCUMENTS

| | | |
|---|---|---|
| JP | 5-295675 | 11/1993 |
| JP | 5-301339 | 11/1993 |
| JP | 5-318770 | 12/1993 |
| JP | 6-71903 | 3/1994 |
| JP | 6-88048 | 3/1994 |
| JP | 6-128865 | 5/1994 |
| JP | 6-146178 | 5/1994 |
| JP | 6-316147 | 11/1994 |
| JP | 7-90780 | 4/1995 |
| JP | 7-101052 | 4/1995 |
| JP | 3126268 | 11/2000 |

* cited by examiner

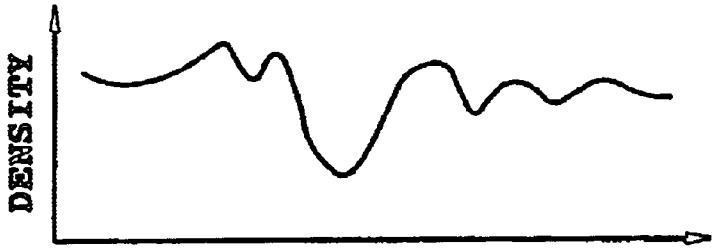
FIG. 22C
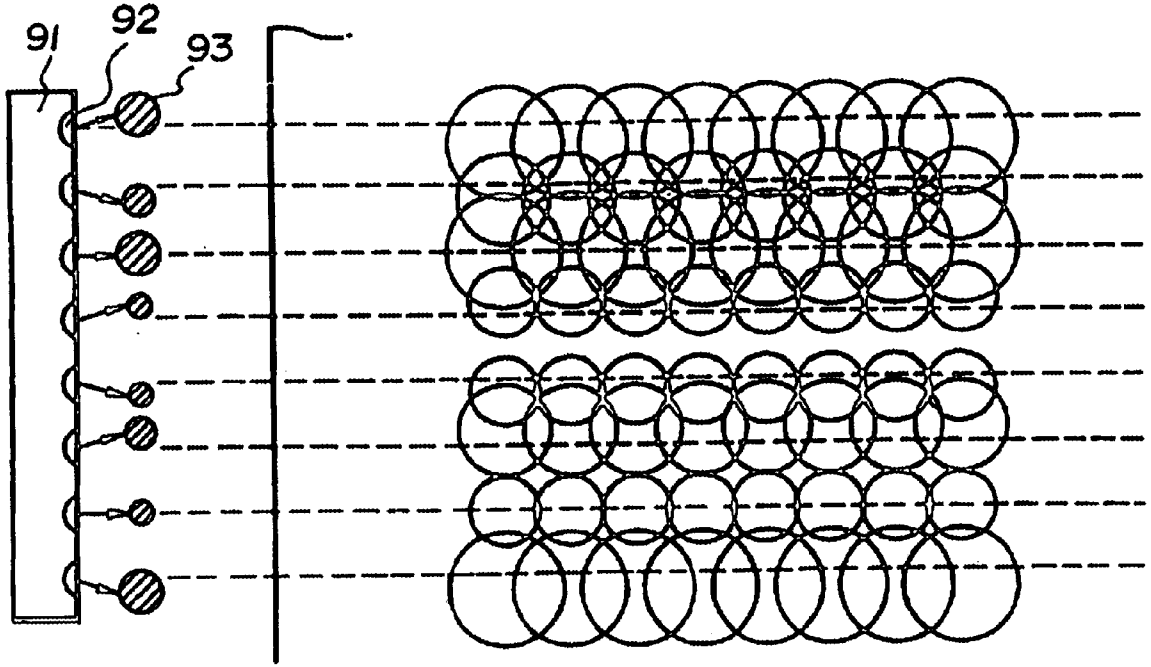
FIG. 22B
FIG. 22A

| PRINTING MEDIUM | QUALITY | INK EJECTION METHOD | PRINTING METHOD | OTHERS |
|---|---|---|---|---|
| COMMON PAPER | STANDARD | KCMY 100% | KCMY 50%X2pass RECIPROCATIVE SCAN | |
| COMMON PAPER | HIGH QUALITY | K200% CMY100% | K 50%X4pass RECIPROCATIVE SCAN CMY 25%X4pass RECIPROCATIVE SCAN | |
| OHP FILM | HIGH QUALITY | K200% CMY100% | K 25%X8pass RECIPROCATIVE SCAN CMY 25%X4pass ONE-WAY SCAN | |
| COATED PAPER | HIGH QUALITY | KCMY100% | KCMY 25%X4pass ONE-WAY SCAN | |
| CLOTH | STANDARD | KCMY200% | KCMY 25%X8pass RECIPROCATIVE | SUCKING RECOVERY OPERATION BASED ON INTEGRATED DOT NUMBER |
| CLOTH | BLACK EMPHASIS | K400% CMY200% | K 50%X8pass RECIPROCATIVE SCAN CMY 25%X8pass RECIPROCATIVE SCAN | SUCKING RECOVERY OPERATION BASED ON INTEGRATED DOT NUMBER |

FIG. 25

INK-JET PRINTER AND PRINTING SYSTEM CAPABLE OF PRINTING ON CLOTHES AND PAPERS, INK TO BE USED IN THE SYSTEM AND PRODUCTION METHOD FOR PRODUCING ARTICLE WITH EMPLOYING THE SYSTEM

BACKGROUND OF THE INVENTION

1. Field of the Invention

The present invention relates to an ink-jet printing apparatus and a printing method to be employed therein for performing printing on a common paper or OHP sheet (transparent sheet having an ink receptacle layer) under a reference printing condition, or a production method of an ink-jet printed article obtained through printing. More specifically, the invention relates to a printer and a printing system which is capable of printing on a common paper and a cloth.

2. Description of the Related Art

Associating with spreading of information processing apparatus, such as copy machines, wordprocessors, computers and so forth and communication apparatus, an ink-jet type printing apparatus are spread as one of apparatus for outputting images processed by the systems set forth above. This type of printing apparatus employs an ink-jet head for forming ink dot on a printing medium to perform digital printing. Many of such apparatus has a printing mode for performing printing employing a transparent sheet with an ink receptacle layer, i.e. so-called OHP sheet as the printing medium. In this mode, in comparison with printing on the common paper, with respect to a black ink, for example, twice greater amount is ejected toward the OHP sheet.

On the other hand, a dedicated ink-jet textile printing apparatus have been put into practical use. In such textile printing apparatus, it becomes possible to produce high precision and high density printing clothes employing dedicated ink-jet recording heads specifically adapted for the textile printing. However, this kind of ink-jet textile printing apparatus are all adapted for industrial application and not for the personal use to permit the user for easily printing. For instance, Japanese Patent Application Laying-open No. 55277/1986 discloses an ink-jet textile printing apparatus dedicated for industrial textile printing. In the disclosed apparatus, a cloth for ink-jet printing containing substantially non-exhaustive compound to the dye as an elemental material of the cloth in a content of 0.1 to 50 Wt % is employed for preventing bleeding of ink in the cloth.

In contrast to this, in the printing apparatus for performing printing on the common paper, there has been proposed apparatus which can perform printing on the clothes Reference is made to commonly owned Japanese Patent Application Laying-open No. 53492/1987. In the above-identified commonly owned publication, there are disclosed a step of forming a recording liquid (ink) receptacle layer having viscosity higher than or equal to 1 Pa s at 25 ° C. in the cloth, overlaying the cloth with such printing liquid receptacle layer with a paper and instantly setting the overlaid cloth and paper in the ink-jet printer, and performing printing, and a step of iron fixing the printed cloth and thereafter removing the printing liquid receptacle layer by using neutral detergent to obtain the printed product. This proposal also employs dedicated printing medium with improved ink receptacle layer to permit image of a predetermined density with achieving enhanced resolution and prevention of blurring and bleeding.

Also, Japanese Patent Application Laying-open No. 61183/1990 discloses an invention for improvement of the cloth per se with paying attention to a difference between the ordinary printing medium, such as the common paper, to be employed in normal printing and cloth, as printing medium. In order to increase surface density in the cloth in performing ink-jet printing, and thus for the purpose of increasing residual ratio of coloring agent of ink in the cloth, a coating layer is formed by coating a non-exhaustive high polymer compound on the whole cloth or the surface of the cloth to be printed, another coating layer is formed on the surface opposite to that to be printed by coating a high polymer compound for preventing ink from flowing out through this surface and whereby increasing residual rate of the ink on the cloth.

In the conventional industrial textile printing as set forth above, the ink-jet head and the apparatus per se can be dedicatedly set adapting to the characteristics of the cloth to be employed. Also, dedicated ink adapted to the ink receptacle layer in the cloth can be prepared (for instance, employing a reactive dye ink). Furthermore, in the industrially performing textile printing, it is not necessary to perform ink-jet printing on the plain paper. Therefore, the apparatus can be used under freely set conditions in consideration of only textile printing.

While the common characteristic construction of the conventional textile printing apparatus is that the diffusion of ink in the cloth is suppressed by the ink receptacle layer for achieving desired density, it can merely achieve improvement of the image quality in the extent that the density of the image to be formed by the ink is maintained by concentrating the ink at the predetermined position. However, such construction is to suppress diffusion of ink and whereby concentrate the ink at predetermined position to maintain the desired density, but cannot achieve further higher density.

On the other hand, the printing apparatus normally available in the market and set primarily for printing on the common paper and so forth employing the ink-jet technology, can perform precise and fine printing on the basis of a color image data transmitted from a host system, and thus is useful for a compact and inexpensive color ink-jet printing apparatus. The ink to be employed in such printing apparatus is normally prepared employing dye or pigment, e.g. direct dye, adapted for printing on the common paper In the OHP printing mode as selective mode in the printing apparatus available in the market, which is set primarily for the paper, such as plain paper, twice greater amount of ink than the printing on the plain paper in the predetermined area is ejected for emphasizing black. Accordingly, when printing on the cloth is performed by means of the conventional field printing apparatus set for the common paper or so forth as the printing medium as disclosed in Japanese Patent Application Laying-open No. 53492/1987, the printed image quality should have been excellent in the light of the technical level at the time of application, it cannot achieve satisfactorily high density and high quality of printed image.

SUMMARY OF THE INVENTION

It is an object of the present invention to provide an ink-jet printing apparatus, a printing system which can print on both of cloth and paper, with high density and high printed image quality superior to the conventional level of image quality in a field printer device set in view of printing on paper, such as a common paper as a printing medium, an ink to be employed in the system set forth above, and a method for producing a product to be produced with employing the system set forth above.

Another object of the present invention is to provide an ink-jet printing apparatus, with which a user can easily print precise and fine image on a cloth utilizing characteristics of existing general purpose ink-jet printing apparatus and with solving the problems of difference of ink absorbing condition due to difference of fibrous tissue and surface configuration, and difference of coloring characteristics between the paper and the cloth.

A further object of the present invention is to solve the problem in the prior art and to provide a printing system which enables to optimally utilize characteristics of the ink-jet printing in printing on the cloth and the paper by providing printing condition effective for adaption to difference of ink absorbing condition and coloring characteristics of the cloth due to difference of fibrous tissue and surface configuration and without requiring improvement of the ink receptacle layer in the cloth, for the field printing apparatus set typically for paper, such as the common paper and so forth.

A still further object of the present invention is to provide a printing system which enables to optimally utilize characteristics of the ink-jet printing in printing on the cloth and the paper by providing an appropriate printing condition for printing on the cloth with a color ink other than black ink.

A yet further object of the present invention is to provide a printing system which is capable of excellent printing on both of the cloth and the paper by providing an appropriate condition depending upon the kind of the cloth in improving the printed image quality for the cloth utilizing a reference for the field printing apparatus which is set with taking the paper, such as the common paper as reference for the printing medium.

It is observed a phenomenon specific to the cloth newly found during study for improvement of the printing quality for the cloth utilizing the reference for the plain paper of the field printing apparatus that near the allowable limit of ink absorption, abrupt deformation is caused in the cloth to cause significant cockling in the extend not being conventionally expected from the behavior of the paper. In such case, while the improvement of the density of the image can be achieved, since the cloth per se is fixed in the cockling condition, the quality of the final product can be degraded. Accordingly, it is another object of solve this new problem.

An improvement of the image density adapted to cloth can be achieved with utilizing mode for performing printing on the common paper under the reference printing condition by providing an ink-jet printing apparatus employing an ink-jet head and performing printing by ejecting an ink to a printing medium from the ink-jet head while the ink-jet head and the printing medium are relatively moved, comprising preferential mode for performing printing under conditions as taking a plain paper as reference of the printing medium, cloth printing mode for performing printing on a cloth with setting a condition, in which at least one of the conditions in the preferential mode is set for higher image quality, and the preferential mode being set preferentially to the cloth printing mode, and the cloth printing mode is performed in place of the preferential mode when the cloth printing mode is set.

A still further object of the invention is to provide an ink-jet printing system present which can perform excellent printing both on the cloth and the paper by preferentially providing appropriate printing condition depending upon the kind of the cloth upon improving printed image quality for the cloth utilizing a reference for the field printing apparatus which is set with taking the paper, such as the common paper as reference for the printing medium.

In order to improve operability for the operator without causing complexity and facilitate setting of reasonable printing mode utilizing the reference for the common paper of the printer, conditions for printing can be set by a host computer which generates an image signal by differentiating at least one of the conditions in the cloth printing preferential printing mode from a printing condition in a mode for performing printing on other printing medium, and one or more cloth printing preferential modes for performing printing on the cloth and switching means for selecting one or more cloth printing preferential mode can be set on the apparatus performing printing operation according to the image signal to be printed.

The effective and concrete content of the present invention is an ink-jet printing system which can eject a plurality of colors of inks and the ink ejection amount for the printing medium is increased for at least one of the colors among a plurality of inks, and in the ink-jet printing system which can eject a plurality of colors of inks, among inks to be ejected in the ink-jet printing system capable of ejecting a plurality of colors of inks, the ejection amount of the ink for black color printing is set to be greater than or equal to the ink ejection amount for other colors.

It should be noted that, in the present invention, the cloth to be employed as the printing medium includes all of woven fabrics, non-woven fabrics and other clothes irrespective of the elemental material, weaving type, thickness. There are a large number of kinds of fibers forming the clothes from natural fibers to synthetic fibers, which have wide variety of ink absorbing characteristics. Therefore, even for increasing the ejecting amount of the ink to the cloth, the amount to be ejected cannot be determined in straightforward manner. Also, in application of the ink-jet printing system for the textile printing, there are wide variety of images (patterns) to be printed, for which high density is not always desirable. Furthermore, when the image (pattern) is not only a single color but also a multi-color, it is quite possible to require different density per color. Therefore, even when printing is performed on the cloth by the ink-jet system, it is substantially not possible to provide one printing mode adapted to the cloth in general sense as the printing medium to perform printing for clothes of all conditions. For instance, when a multi-color image is to be printed and when the densities are differentiated per colors, it may be possible to express such variation of the density by tone production method by density of each element, such as dither method and so forth. However, in such case, greater number of tones may results in lowering of resolution and requires longer period in image signal processing. For example, when the image to be printed has high image density, it can be insufficient to have the dedicated mode.

As set forth above, in order to adapt the ink-jet system to variety of clothes, it can be insufficient to have one kind of printing mode for clothes separately from the printing mode for papers. Therefore, it is desirable to provide capability of setting more kinds of cloth printing modes. It is further desirable to provide capability of automatically or manually switching one or more cloth printing modes. In addition, in certain content, it may be possible to have a printing mode common to the conventional system. Therefore, it is a further object of the present invention to provide an ink-jet printing system which can easily improve the level of the system without making the system bulky and causing increasing of the cost.

For realizing printing in ink-jet system, digital form image is handled for forming the image by dots. Accordingly, in the ink-jet printing system, a host computer is provided for performing digital conversion or signal processing of the image signal and feeding an ejection signal to an ink-jet head. In such case, it becomes possible to perform switching of setting of the cloth printing mode set forth above on the computer simultaneously with feeding of the image signal. In particular, there has been progressed a GUI (Graphic User Interface) environment and bidirectional communication is becoming possible. Such system is useful.

Alternatively, switching of setting of the cloth printing modes as set forth above, can be performed at an ejection control portion of the ink-jet head. Therefor, is possible to perform switching at the side of the printing apparatus. This manner is advantageous in comparison with switching performed by the host computer, since switching can be instantly performed with verifying the actual printing image.

In the case where different density is expressed per color, it is effective to permit appropriate setting of the ink ejection amount per each color. Generally, when a multi-color image is expressed, the image can be expressed employing four kinds of colors, i.e. black, cyan, magenta and yellow. From this, setting of the ejection amount of respective inks by providing setting of the increased ejection amount for at least one color. Particularly, when the density of the black is higher than that of other colors, sharpness can be clearly seen on the printed image. Therefore, it is effective to permit black to be ejected in greater amount than that of other colors.

In a first aspect of the present invention, there is provided an ink-jet printing apparatus employing an ink-jet head and performing printing by ejecting an ink to a printing medium from the ink-jet head while the ink-jet head and the printing medium are relatively moved, comprising:

setting means for setting one of a cloth printing mode for performing printing on a cloth and another printing mode for performing printing on another printing medium; and printing control means for performing printing operation for the printing medium corresponding to the printing mode, the printing mode being set by the setting means.

In a second aspect of the present invention, there is provided an ink-jet printing apparatus employing an ink-jet head and performing printing by ejecting an ink to a printing medium from the ink-jet head while the ink-jet head and the printing medium are relatively moved, comprising:

print control means performing printing by repeating operation of reciprocating the ink-jet head on the printing medium and operation for feeding the printing medium;

the print control means performing ejection ink during forward and reverse travel of the ink-jet head and completing printing for each region defined by dividing a printing region of the cloth through a plurality times of reciprocating operation when the cloth is employed as the printing medium.

In a third aspect of the present invention, there is provided an ink-jet printing apparatus employing an ink-jet head and performing printing corresponding to a set printing mode by ejecting an ink to a printing medium from the ink-jet head while the ink-jet head and the printing medium are relatively moved, comprising:

preferential mode for performing printing under conditions as taking a common paper as reference of the printing medium;

cloth printing mode for performing printing on a cloth with setting a condition, in which at least one of the conditions in the preferential mode is set for higher image quality; and means for setting the preferential mode preferentially to the cloth printing mode, and for setting the cloth printing mode in place of the preferential mode when the cloth printing mode is selected.

In a fourth aspect of the present invention, there is provided an ink-jet printing apparatus employing an ink-jet head and performing printing by ejecting an ink to a printing medium from the ink-jet head while the ink-jet head and the printing medium are relatively moved, comprising:

reference cloth printing mode for performing printing on a cloth with taking a color ink printing condition for printing by ejecting different colors of inks, and a black ink printing condition for printing by ejecting black ink different from the different colors of inks as preferential condition; and selected cloth printing mode for performing printing under a condition, in which at least one of the color ink printing condition and the black ink printing condition is modified depending upon the kind of the cloth; and means for setting the selected cloth printed mode in place of the reference cloth printing mode when the selected cloth printing mode is selected.

In a fifth aspect of the present invention, there is provided an ink-jet printing system employing an ink-jet head and performing printing by ejecting an ink to a printing medium from the ink-jet head while the ink-jet head and the printing medium are relatively moved, comprising:

one or more cloth printing preferential modes for performing printing on a cloth; and switching means for selecting the one or more cloth printing preferential modes;

wherein conditions of a printing made for performing printing on other printing medium can be set by in differentiating at least one of the conditions in the cloth printing preferential printing mode a host computer which generates an image signal.

In a sixth aspect of the present invention, there is provided an ink-jet printing system comprising:

a plurality of ink tanks storing a plurality of inks, the plurality of inks being exchangeable depending upon the cloth to be used, and respective of the plurality of inks being the ink defined in claim 19.

In a seventh aspect of the present invention, there is provided an ink-jet printing apparatus employing an ink head mechanism which can eject a plurality of colors of inks, and performing printing by ejecting inks from the ink-jet head mechanism to a printing medium while the ink-jet head mechanism and the printing medium are moved relatively to each other, comprising:

preferential printing mode being a preferential mode and taking a maximum ink amount to be provided per unit area of a common paper for color ink different from black ink as reference printing condition;

reference cloth printing mode being a mode for printing on a cloth and setting a maximum ink amount at double of the reference printing condition for the color inks and at three times of the reference printing condition for the black ink;

selected cloth printing mode for performing printing under a condition which is set by modifying at least one of the maximum ink amount to be provided in the unit area of the color ink and the black ink in the reference cloth printing mode, depending upon a kind of cloth; and means for setting the selected cloth printing mode in place of the reference cloth printing mode.

In an eighth aspect of the present invention, there is provided an ink-jet printing apparatus employing an ink-jet head and performing printing by ejecting an ink to a printing medium from the ink-jet head according to a set printing mode while the ink-jet head and the printing medium are relatively moved, comprising:

preferential printing mode for performing printing under a reference printing condition on an OHP sheet as preferential mode;

cloth printing mode for performing printing on the cloth under conditions in which at least one of conditions in the reference printing mode in the preferential printing mode is modified to a condition for higher image quality; and means for setting the preferential printing mode preferentially to the cloth printing mode and for setting the cloth printing mode in plane of the preferential printing mode when the cloth printing mode is selected.

In a ninth aspect of the present invention, there is provided an ink-jet printing apparatus employing an ink-jet head and performing printing by ejecting an ink to a printing medium from the ink-jet head according to a set printing mode while the ink-jet head and the printing medium are relatively moved, comprising:

preferential printing mode for performing printing under a reference printing condition on a plain sheet as preferential mode;

cloth printing mode for performing printing on the cloth treated for stiffening to have clark stiffness greater than or equal to 10 and smaller than or equal to 400 and containing a polarized dye fixing agent under conditions in which at least one of conditions in the reference printing mode in the preferential printing mode is modified to a condition for higher image quality with increased ink ejection amount; and means for setting the preferential printing mode preferentially to the cloth printing mode and for setting the cloth printing mode in place of the preferential printing mode when the cloth printing mode is selected.

In a tenth aspect of the present invention, there is provided an ink-jet printing system comprising:

a host computer connected to the ink-jet printing apparatus as defined in claim 31 and generating an image signal to be printed, on which host computer, the ink ejection amount per unit area for the black ink and the color ink other than black ink can be modified to have the upper limit at less than or equal to four times of the reference printing condition in the preferential printing mode.

Next, the printing method adapted to the present invention is characterized by thinning of the image data to be printed according to the predetermined image data pattern, performing ejection of the ink with reciprocally moving the ink-jet head in the primary scanning direction according to the thinned image data, and at every reciprocal movement of the ink-jet head, forming the image by feeding the printing medium in a distance less than or equal to the length of the ejection orifice string.

In viewpoint of printing on the cloth, the present invention is directed to the objective image for printing, which image is primarily a multi-color image rather than the monochrome image. When such image is to be printed, a divided printing as discussed later is frequently employed. Namely, upon printing the color image, various characteristics, such as color development ability, toning ability, uniformity and so forth have to be excellently achieved in comparison with character printing. Particularly, concerning uniformity, the following problem has been known conventionally. Namely, in the ink-jet head, in which a plurality of ejection orifices are arranged, small tolerance in the configuration of respective individual ejection orifices caused during production process, may cause fluctuation in ejection amount and ejecting direction of the ink ejected from respective ejection orifices. This results in fluctuation of density of the printed image and thus causes degradation of the image quality. The concrete example will be discussed with reference to FIGS. 21 and 22. In FIG. 21A, a reference numeral 91 denotes an ink-jet head, in which a plurality of ejection orifices are arranged. It should be noted that, for the purpose of illustration, the ink-jet head is assumed to be constituted with eight ejection orifices 92. The reference numeral 93 denotes an ink droplet ejected from the ejection orifices 92. It is ideal that the ink droplet is uniform in ejection amount and ejecting direction and is not deflected. When ejection can be performed in this manner, uniform size of dots can be formed, and whereby uniform image without fluctuation of the density through overall image can be obtained (see FIG. 21C). However, in practice, each ejection orifice fluctuates in ejection characteristics to cause fluctuation in the ink droplet size and ejecting direction as ejected through such ejection orifices as shown in FIG. 22A when printing is performed in the same manner to the above. Then, dots are formed as illustrated in FIG. 22B. In the example of FIG. 22B, it becomes not possible to completely fill the printing area with dots formed by the ink droplet ejected along the primary scanning direction (left and right direction in the drawing). As a result, on the overall surface of the printing medium, blank portions appear cyclically. Also, it forms the portion, in which the dots overlaps excessively. Further, as can be seen at the center of FIG. 22B, it may leave blank (white) band. The image formed by an aggregate of the dots formed in the manner set forth above may have the density distribution with respect to the arrangement direction of the ejection orifices as illustrated in FIG. 22C, which should appear for the human eye as density fluctuation.

As a measure for such density fluctuation, the following method has been proposed, The method will be discussed with reference to FIGS. 23A to 23C and 24A to 24C. In the method, as shown in FIG. 23A, for completing printing in a region shown in FIGS. 21A to 22C, the ink-jet head 91 is scanned three times. However, in the half of the region shown in FIGS. 21A to 22C, i.e. in a region where four pixels are arranged, printing is completed by scanning twice. In this case, eight ejection orifices in the ink-jet head is divided into upper four ejection orifices and lower four ejection orifices and are differentiated the scanning regions for respective groups of ejection orifices. The dots formed by ejection of ink through ejection orifices at the first scanning cycle are thinned into approximately according to a predetermined data array (hereinafter referred to "print mask"). In the second scanning cycle, the dots are formed for the remaining half of the image data to complete printing for respective regions. Such method of printing is hereinafter referred to as "divided printing method". By employing such divided printing method, even when the ink-jet head which otherwise causes fluctuation in formation of dots as illustrated in FIGS. 22A to 22C, is employed, the fluctuation can be absorbed since the dots in the scanning direction are formed with mutually different two ejection orifices. As a result, the printed image becomes as illustrated in FIG. 23B. As can be seen from FIG. 23B, the black band or white band become not so perceptible. Accordingly, the density fluctuation on the printed image can also be absorbed as illustrated in FIG. 23C, in comparison with the case illustrated in FIG. 22C.

Upon performing printing in the manner set forth above, the image data is divided in complementary manner according to a predetermined array for the first and second scanning cycles. This typical image data array (thinning pattern) is to exclude every other dot data in vertical and lateral directions in lattice fashion. Therefore, in a unit printing region (here an array of vertical four pixels), printing is completed by printing in lattice fashion in the first scanning cycle and by printing in reversed lattice fashion in the second scanning cycle. FIGS. 24A, 24B and 24C illustrate the process how the printing is progressed with employing the lattice and reversed lattice patterns when the ink-jet head having eight ejection orifices similar to those of FIGS. 21A to 23C. At first in the first scanning cycle, printing of the lattice pattern is performed employing lower four ejection orifices to form the hatched dots (FIG. 24A). Then, in the second scanning cycles, paper is fed for four pixels (half length of the ejection orifice array) and printing of the reversed lattice pattern (non-hatched dots) is performed (FIG. 24B). At the third scanning cycle, paper is further fed for four pixels (half length of the ejection orifice array) and printing of the lattice pattern (hatched dots) is performed (FIG. 24C). As set forth above, by repeating paper feeding for four pixels sequentially and by alternately performing lattice pattern printing and reversed lattice pattern printing, printing for an array of four pixels is completed al every scanning. As set forth, by completing printing for one printing region by ejection through mutually different ejection orifices, it becomes possible to obtain high quality image with lesser density fluctuation.

Also, since the ink density to be simultaneously ejected on the cloth becomes low, penetration of ink in the depth direction becomes lesser. Therefore, it can be expected that greater amount of coloring material of tile ink, such as dye and so forth, can be maintained on the surface of the printing medium and thus to achieve higher printing color density. From this point of view, the printing method set forth above, which is applied to the present invention, may be quite effective for cloth printing.

While the foregoing discussion has been given for the construction where printing is completed by scanning the same printing region twice, the divided printing method may be more effective at greater number of dividing. For instance, by reducing the number of pixels to he printed in one scanning cycle to be half and setting paper feeding magnitude in each scanning cycle to be the magnitude corresponding to two pixels, printing for dots arranged in the scanning direction is completed by four mutually different ejection orifices. Therefore, the density fluctuation can be further reduced to provide better quality of image with increased printing color density.

Next, further advanced construction in the case where the divided printing system is applied for the textile printing, will be discussed. Namely, when reciprocative printing is performed, due to deflection of ejecting direction of each individual ejection orifice to differentiate the dot forming positions at forward printing and at reverse printing. Also, in color printing, the order of ejection of respective color inks is differentiated between the forward printing and reverse printing. The difference of printing conditions between the forward printing and the reverse printing should significantly affect for printed image quality. For example, when different colors of inks are ejected in overlaying manner to the same position or a thin line is drown, difference of shifting direction of the dot forming position in forward printing and reverse printing may cause disturbance of the image. Also, in the case where the different colors of inks are overlaid at the same position, reversal of ejecting order may cause variation of the color taste of the color generated by mixing the colors. For this, it is difficult to accurately control the dot forming position of the ejected inks in the forward and reverse printing and to appropriately control penetration of the ink. Therefore, the normal mode printing is typically performed as one-way printing instead of reciprocative printing.

In the study made by the inventors with respect to behavior in performing printing on the cloth by means of the ink-jet printing system, it has been found that the foregoing problem is rarely caused. Namely, irrespective of the order of ejection, the ink reaching the cloth is absorbed with uniformly spreading in the cloth. By this, the diameter of the dot to be formed becomes relatively large and in view of the feeling of the cloth print, not so strict dot forming position precision is required. Therefore, reciprocative printing system is effective in the case where the cloth is employed as the printing medium.

Namely, in comparison with conventional printing on the paper, lesser constraints in application of the divided printing method for printing on the cloth are applicable. Therefore, the divided printing method can be further advanced. For example, when the cloth printing mode is selected, an appropriate print mask may be selected depending upon the kind of the cloth to be printed. Also, overlaying printing for the same portion of the cloth can be done freely. Also, the image printing density can be determined arbitrarily. By this, higher quality and printing on the cloth and widening of applications can be achieved. For example, by determining the adequate print mask, the ink-jet head can be reciprocally scanned according to the selected printing mask with setting the ink ejection amount freely, at a rate of 100%, 200%, 300%, 400%, 500% and so forth In the setting of the ink ejection amount, as a condition for solving the problem of significant cockling of the cloth in the extent cannot be expected from the behavior of conventional paper printing, due to abrupt deformation near the allowable limit of ink reception, it can be employed that the maximum ink ejection amount per unit area in printing on the cloth is limited to be greater than the maximum ink ejection amount with taking maximum ink ejection amount upon printing on the common paper as reference, but less than or equal to three times (optimally double) of the maximum ink ejection amount in common paper printing, with respect to the color inks, and to be greater than the maximum ink ejection amount with taking maximum ink ejection amount upon printing on the common paper as reference, but less than or equal to four times (optimally three times) of the maximum ink ejection amount in common paper printing, with respect to the black ink. A reference cloth printing mode preferably has above-described condition to make ejected ink amount per unit area of the cloth to be maximum.

Also, the preferred condition of the ink to be employed in the present invention, is that the ink is a water base ink containing surface active agent, the content of the surface active agent is less than critical micell concentration with respect to the ink and is greater than the critical micell concentration with respect to the water when water is added to the surface active agent. The inks are used in such a manner that a plurality of ink tanks respective containing a plurality of kinds of inks for ink-jet printing system are exchangeable depending upon the cloth to be employed. It should be appreciated that as application of the present invention, it is possible to perform printing either by directly printing on the cloth or by printing on another transfer medium and subsequently transferring the printed image on the transfer medium to the cloth utilizing the feature of the present invention.

As the ink to be used in the ink-jet system, inks capable of forming excellent image on the common paper available in the market and having high penetration speed with little bleeding at the boundary have been developed recently. In contrast, when printing is performed with conventionally available ink, penetration speed for the common paper normally available in the market is low to cause unnecessary color mixture at the boundary between the simultaneously printing dots. Therefore, bleeding is caused at the boundary of the colors to cause degradation of the printed image quality. Particularly, in a graphic image, such as graph, a part of table, drawn picture and so forth, it is frequently require to print overall area of a portion of the image with a single color ink. In such case, employing the ink having high penetration speed, in addition to setting of the printing condition according to the present invention, degradation of the image quality can be successfully prevented.

Also, certain kinds of common paper may have fluctuation of the ink penetrating conditions on the paper surface to cause degradation of uniformity or local tinting can be caused in the portion printed with the single cover (this portion will be hereinafter referred to as "solid print portion"). It is considered that degradation of the solid print portion as set forth above is caused due to non-uniformity of the surface of the common paper. Due to non-uniformity of the surface of the common paper, the ink droplet ejected penetrates selectively through a portion having low water repellency caused by gap between fibers, sizing agent and so forth. This results in formation of irregular configuration of dot, such as star shaped configuration, instead of the circular dot. Conventionally, such problem cannot be solved without employing a paper with a special coating. However, most of such coated papers are expensive and distributed through a limited route. Therefore, employment of such coated paper is not typical for the field users.

However, it is effective measure for the problem set forth above to improve penetration ability and penetration speed of the ink into the common paper by adding the surface active agent in the preferred condition according to the present invention to the ink. Addition of the surface active agent may causes significant increasing of viscosity of the ink near the ejection orifice due to evaporation under low temperature environment when the excess amount of the surface active agent is added. This can cause difficulty of maintaining the ejection performance by normal recovering process Also, lowering of surface tension to the limit and elevating of the viscosity may cause degradation of convergence of the ink droplet to cause spreading of the ink as ejected to cause primary droplet and subsequent fine droplets (satellite). By generation of satellite, degradation of the image quality, such as degradation of the character quality or of the straightness of rules. Furthermore, due to increasing of viscosity of the ink, refiling after ejection takes relatively long period to affect for ejection frequency.

In order to satisfactorily solve the problem set forth above, it is necessary to adjust the amount of the surface active agent in view of critical micell concentration versus ink and versus water within an appropriate range. The commonly owned Japanese Patent Application No. 164845/1993 discloses that higher concentration of the surface active agent is desired in view point of promotion of penetration of ink into the printing medium, and that, in view point of prevention of bleeding and maintaining uniformity of solid print, it is practically required that the amount of the surface active agent is to be greater than critical micell concentration in the water, and in view of improvement of the ejection characteristics, improvement of unit dot quality and facilitating of recovery process, the amount of the surface active agent is to be less than the critical micell concentration versus the ink.

As set forth above, for the ink-jet printing system capable of excellent printing for a plurality of kinds of printing media including the cloth, which the present invention seeks for, the ink having relatively high penetration characteristics by adding the surface active agent as set forth above is effective. In particular, such ink is quite effective when it is applied for cloth printing mode. Since it is possible that the ink ejection amount for the cloth is greater than that for the paper, the normal ink is not satisfactory in the relative ink absorption speed. Therefore, in such case, when different colors of inks are ejected at relatively high speed, mixture of color with the adjacent and different color ink droplet is caused before complete absorption of the ink in the cloth. Such mixture of the colors is perceptive as bleeding of the boundary of the color. In order to prevent this, there can be considered such approaches to increase number of multi pass to progress printing with drying inks, and to provide a waiting period of carriage per one cycle of scanning to wait for absorption of the ink. However, either method tries to promote drying by taking a time, it requires longer period for outputting the image than that required in printing with other printing medium. In view of this, by employing the penetration drying ink containing the surface active agent, absorption and drying of the ink can be done instantly. Therefore, it becomes unnecessary to spend a time for drying the ink and high printing color density can be attained. By providing penetration ability of the ink by addition of the surface active agent, ink absorption ability into the fiber forming the cloth can be improved to make it possible to attain uniform dying of the fiber near the surface of the cloth. Also, it becomes possible to prevent the ink from excessively penetrating in the cloth in the depth direction. Therefore, the ink added the surface active agent is applicable as the ink suitable for cloth printing mode.

In addition to this, it is effective to employ a reactive dye which has been frequently used in the conventional textile printing technology, as coloring agent to be contained in the ink, for applying the cloth printing mode for greater number of kinds of clothes. In the case of ink employing the reactive dye, while direct fixing ability is low, it becomes possible to obtain hue with clear and high durability on the cloth by reaction of —OH group in the fiber and the dye by applying alkali treatment for the cloth.

Also, as the ink, any appropriate inks can be employed as long as the necessary coloring material is contained, the ink containing not only the dye but also pigment can be employed.

When a plurality of kinds of inks can be utilized, it is the preferred construction of the ink-jet printing system according to the present invention to store a plurality of applicable inks in ink tanks and to use them with exchanging depending upon the cloth to be printed. The inks of respective colors are not required to be the same kind of inks in four colors and two or more kinds of inks can be used in combination to mixedly set in the ink-jet system. For instance, it is possible to use ink with normal penetration ability to be used for paper for black, and to use highly penetration drying type inks added the surface active agent for other colors, i.e. cyan, magenta and yellow. With this combination, even in the even ejection amount for all colors, the black ink may be maintained near the surface of the cloth in the greater amount than other colors to make the density of black higher than other colors.

On the other hand, various inks listed above is applicable not only for printing on the cloth but also on other printing media. Accordingly, in the ink-jet printing system according to the present invention, it is possible to appropriately select ink per se in conjunction with selection of the printing mode depending upon the printing medium.

Next, application of the present invention is a producing method of ink-jet printed article characterized that it is possible to perform printing either by directly printing on the cloth or by printing on another transfer medium and subsequently transferring the printed image on the transfer medium to the cloth.

Here, when direct printing is performed, it may be possible to perform stiffening process to provide clark stiffness to be greater than or equal to 10 and smaller than or equal to 400. Also, the cloth may contain polarized dye fixing agent so that the image can be fixed on the cloth simultaneously with printing operation. Furthermore, it is also possible to perform fixing process with the polarized dye fixing agent after completion of printing on the cloth.

In addition to this, the cloth, for which printing is completed, may be subject of heating process or wet heating process to fix the image on the cloth, and further subject of washing after fixing process.

In the ink-jet printing system according to the present invention, printing can be performed directly on various clothes generally available in the market. However, in such case, in the conventionally existing ink-jet printing apparatus, loading system is typically constructed to once release a member for depressing the cloth as the printing medium from a cylindrical platen roller to manually set the printing medium and then to depress the depression member to tightly fit the cloth on the platen roller. In such printing apparatus, most of cloth may be transported and printed. However, since the cloth is manually loaded, it is difficult to wind the cloth on the platen without causing cockling, to align the texture to the transporting direction. Therefore, difficulty is encountered in performing fine and precise printing. By repeated use of the release mechanism, the depression force may be lowered to make it difficult to stabilize transportation Also, loading operation per se a cause of low operability. Therefore, it is preferred to employ an automatic loading mechanism for the transporting means which has been frequently employed in the recent ink-jet printing apparatus. In order to enable loading of the cloth, difficulty is encountered for lack of stiffness in the cloth in comparison with the paper.

As a construction for loading the cloth to the automatic loading mechanism, there are proposals in commonly owned Japanese Patent Application No. 108226/1993 and Japanese Patent Application No. 230369/1993. In these prior proposals, stiffening and flattening of the cloth is proposed. Even in the ink-jet printing system of the present invention, it is effective to employ the stiffened cloth for fine and precise printing and stable transportation. Accordingly, in the present invention, it is preferred that the cloth is provided stiffness having clark stiffness greater than or equal to 10 and smaller than or equal to 400. It should be appreciated that clark stiffness is the value expressed by Clark method defined in JIS-P8143.

In addition, in the stiffening process, concerning the process employing sizing agent of carboxymethyl cellulose, polyvinyl alcohol, acrylamide, starch, gum tragacanth, gua gum and so forth, the sizing agent is washed through the washing process to recover the feeling of the cloth after completion of printing. In order to avoiding washing out of dye during washing, process with cationic dye or dying control process with fixing agent and so forth is typically performed before printing. However, only by such method, it may be insufficient for certain ink, further to say certain dye and ink ejection method. It is effective to add a process with dye fixing agent.

The process with dye fixing agent, herewith referred to, is preferably a process to add a polarized material to the cloth since the dye containing in the ink to be used for printing on the cloth, as coloring agent is typically ionized property. By the process for the cloth, the dye can be coagulate by ion binding during and after printing to improve fixing ability of the dye to the fiber.

Therefore, the treatment for the cloth may be performed either before or after printing. As a polarized material for such treatment, water soluble cationic high polymer, such as polyarylamine salt, polyarylsulfone, dithylarylarmmonium-chloride and so forth, anionic high polymer, such as vinyl acetate polymer, denaturation synthetic rubber and so forth.

Such polarized dye fixing agent is solved, dispersed or forming emulsion in a solvent, such as water, alcohol or so forth, and applied on the cloth by dipping, coating or spraying to impregnate or deposit. When treatment is performed after printing, it is more effective to perform treatment with the treatment liquid with increased viscosity with the non-water based type agent in order to prevent bleeding or flowing out of the dye before coagulation.

Since these treatment agent may be removed by washing, it may not degrade the feeling of the original cloth. Furthermore, for enhancing durability of image after treatment, it is also effective to perform color fixing, heat treatment, such as iron, or vapor treatment, such as steamer. Of course, the cloth may be heated during printing by the ink-jet printing system.

In addition the above, known preparatory treatment for the cloth may be applicable for the present invention as required. As examples for such known preparatory treatment, alkali material, water-soluble high polymer, synthetic high polymer, water-soluble metal salt, urea and thiourea may be contained in the cloth. The followings are the typical examples of these materials.

As alkali material, alkali metal hydroxide, such as sodium hydroxide, potassium hydroxide, amine, such as mono-, di- and triethanolamine and so forth, carbonates or alkali metal bicarbonate and so forth, such as sodium carbonate, potassium carbonate, sodium bicarbonate and so forth can be listed. Also, alkali material may include organic acid metal salt, such as calcium acetate, barium acetate and so forth, ammonia, ammonia compound and so forth. Also, sodium trichloroacetate which becomes alkali material through steaming or dry heating, may also be included in the alkali material. Particularly preferred alkali material are sodium carbonate and sodium bicarbonate.

As the water-soluble high polymer, natural water-soluble high polymer, such as corn, starches of wheat, cellulose type material, such as carboxymethyl cellulose, methyl cellulose, hydroxyethyl cellulose and so forth, polysaccharide, such as sodium aiginate, arabic rubber, locust bean gum, tragacanth gum, gua gum, tamarined seed and so forth, protein material, such as gelatin, casein and so forth, tannin type material, lignin type material may be included.

As the synthetic high polymer, polyvinyl alcohol type compound, polyethylene oxide type compound, acrylic acid type water-soluble high polymer, maleic anhydride type water-soluble high polymer and so forth are included. Among these, polysaccharide type high polymer, cellulose type high polymer are preferred.

As the water-soluble metal salt, compounds forming typical iron crystal, and having pH in a range of 4 to 10, Such as alkali metal, halide of alkali earth metal, may be included. As typical example of such compound, sodium chloride, sodium sulfate, potassium chloride, sodium acetate and so forth are included as alkali metal type compound, and calcium chloride, magnesium chloride and so forth may be included as alkali earth metal type compound. Amongst, salts of sodium, potassium, calcium are preferred.

In the preparatory treatment, there is no limitation for the method to include the material set forth above in the cloth. Typical methods may be dipping method, padding method, coating method, spraying method and so forth.

Also, in order to perform fixing process of the coloring agent in the ink, such as dye to the fiber after completion of ink-jet printing, it may be the printed product in the conventionally known method. For instance, when alkali treatment is performed as the preparatory treatment, it may be performed by steaming method, HT steaming method, thermo-fixing method and so forth. When cloth not preliminarily alkali processed is employed, the treatment may be performed by alkali pad steaming method, alkali blotch steaming method, alkali shock method, alkali cold fixing method and so forth may be employed.

It is also possible to produce the printed product by one printing the image on a transfer media and then transfer the printed image to the cloth. This is the method to print the desired mirror image to other transfer medium, then to contact the printed surface to the cloth to physical or chemical transfer and penetrate the mirror image formed on the transfer medium to the cloth. In such case, as a special printing method for cloth printing, formation of special mirror image becomes necessary in addition to adjustment of the ink ejection amount. As the transfer medium to be used for this purpose, property for appropriately holding the ejected ink and easily transfer the formed image to the cloth is required. For example, such transferring medium may be formed by forming an ink holding layer of polyvinyl alcohol, cellulose, wax and so forth on a sheet form support of polyethylene telephthalate, paper so forth. Also, as a means for transferring the image formed on the transfer medium to the cloth, known pressure transfer or melting transfer, in which the transfer medium and the cloth are stacked in tightly fitted position and pressure, heat or laser beam or solvent is applied for transferring the image. Also, the combination of the foregoing method may also be employed.

Accordingly, it is possible to add a printing mode for such transfer printing. Particularly, the foregoing transfer printing method may not be limited the printing medium to receive the transferred image to the cloth. Therefore, the image may be transferred to various printing media. Therefore, for widening the applicable printing medium, it is advantageous to provide such printing mode adapted to the transfer printing as independent mode.

Finally, for the ink-jet printed product produced through the process set forth above, it is possible to obtain final product by cutting and/or sewing the cloth. The ink-jet printing products produced by the ink-jet printing system discussed above can be treated equally to the conventional textile printing product. therefore, cutting and/or sewing can be done freely.

In any case, the ink-jet printing system according to the present invention has one or more cloth printing mode for forming image on the cloth and switching means for selecting the one or more cloth printing mode with conditions, at least one of which is differentiated from the printing condition in the mode for performing printing on the printing medium other than cloth. Therefore, the ink-jet printing apparatus according to the present invention can perform ink-jet printing not only for the conventionally existing printing medium, such as paper, OHP sheet and so forth but also for cloth, freely. The ink-jet printing system utilizing such ink-jet printing technology makes it possible to perform fine and precise color expression not only for industrial application but also for the field of hobby in home use.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings:

FIGS. 22A, 22B and 22C are explanatory illustration showing a practical form in ink-jet printing;

FIG. 25 is an explanatory illustration showing variety of printing modes in one embodiment of the ink-jet printing system according to the invention.

DESCRIPTION OF THE PREFERRED EMBODIMENT

The present invention will be discussed in detail in terms of the preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Embodiment 1

Figure 5:
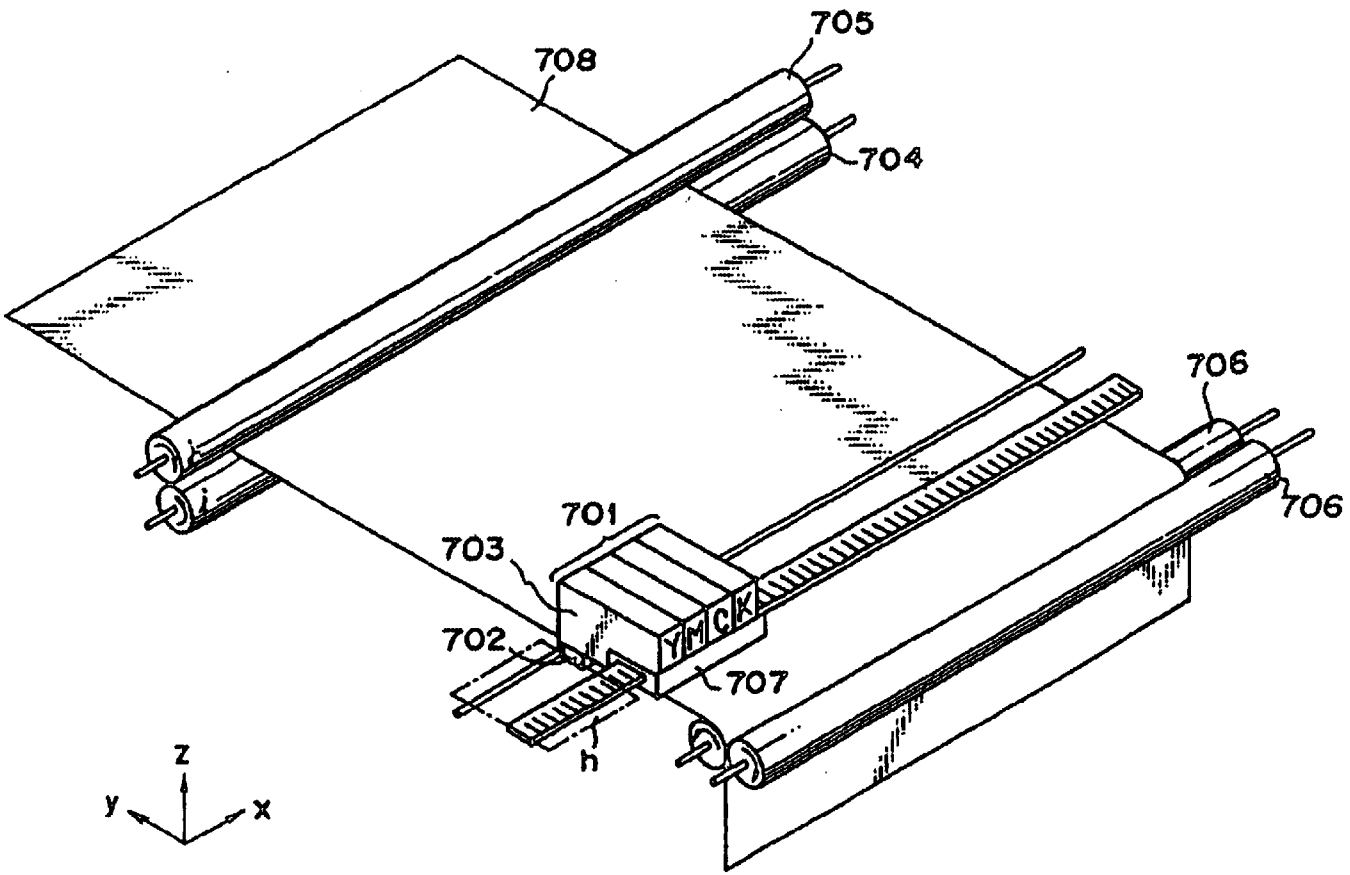
FIG. 5 is a diagrammatic perspective view showing a printing portion in an ink-jet printing system, to which the present invention is applicable.

FIG. 5 shows general construction of a printing portion in one embodiment of an ink-jet printing apparatus according to the present invention. In FIG. 5, the reference numeral 701 denotes head cartridges. The head cartridges 701 comprise an ink tank group 703 storing black, cyan, magenta and yellow inks and an ink-jet head group 702 coupled with respective colors of the ink tanks. In FIG. 5, labeling of K, C, M, Y put on the ink tank group 703 represent that respective color inks of black, cyan, magenta and yellow are stored therein.

The ink-jet printing apparatus of the shown embodiment is dedicated to personal use and has size to be stored in a space of 525 mm of length, 470 mm of width and 210 mm of height. This size is determined in consideration of space in which the printing apparatus is set for the purpose of personal use.

Figure 6:
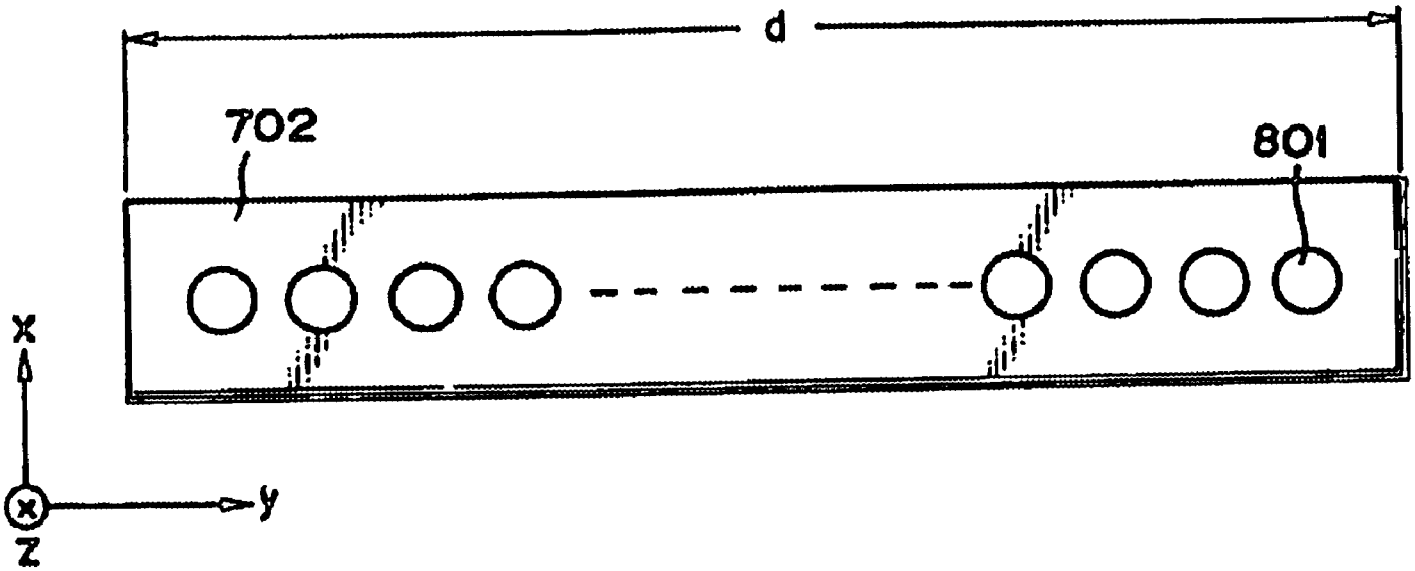
FIG. 6 is an explanatory illustration showing an ejecting orifice array of an ink-jet head to be employed in the ink-jet printing apparatus of FIG. 5.

FIG. 6 is an illustration showing a plurality of ejection orifices arranged in one ink-jet head ejecting one color in the ink-jet head group 702, as viewed along Z direction of FIG. 5. The reference numeral 801 denotes individual ejecting orifice arranged in the ink-jet head. While the ejection orifices 801 are arranged in parallel to y-axis in FIG. 6, it is possible to arrange the ejection orifices in oblique on the x-y plane. In such case, with respect to movement of the head in the x-axis direction, ejection of ink through respective ejecting orifices 801 is performed at respectively shifted timing.

Again referring to FIG. 5, the reference numeral 704 denotes a transporting roller cooperated with an auxiliary roller 705 to rotate respectively in the directions shown by arrows i and j and to feed the printing medium 708 in y-axis direction with clamping the printing medium 708. The reference numeral 706 denote feed rollers which feeds the printing medium 708. The feed rollers 706 also serves similarly to the rollers 704 and 705. The reference numeral 707 denotes a carriage mounting four ink cartridge and moves carrying the ink cartridge during printing operation. The carriage 707 is placed at a home position (h) shown by dotted line during resting in non-printing state and during recovering operation for the ink-jet head.

Before initiation of printing, the carriage 707 placed at the shown home position. The carriage 707 is responsive to a print start command to move in the x-axis direction and to eject ink through a plurality of the ejecting orifices 801 on the ink-jet head group 702 for performing printing on the printing medium in the width d. When printing of the data up to the end of the printing medium, the carriage is moved in the direction of -x to return the original home position h and again perform printing in the x direction. Alternatively, in case of reciprocative printing, next printing is performed during the travel of the carriage in the -x direction. After completion of the first printing, and before initiation of next printing, the printing medium 708 is fed in the y-axis direction for a predetermined length by rotating the transporting roller 704 and the auxiliary roller 705 respectively in the directions of the arrows i and j. Thus, repeating scanning of the carriage 707 and feeding of the printing medium, printing on one printing medium is completed. In the ink-jet printing system set forth above, when the printing mode is switched into a cloth printing mode, ink ejection amount is set at 200% which is double of the ink ejection amount 100% in the printing mode for common paper.

Here, in advance of discussion for operation in a cloth printing mode, discussion will be given for the construction of the ink-jet head group 702 to be employed with reference to FIGS. 7 and 8, and then discussion will be given for a typical ink to be employed in the shown embodiment of the ink-jet printing system.

Figure 7:
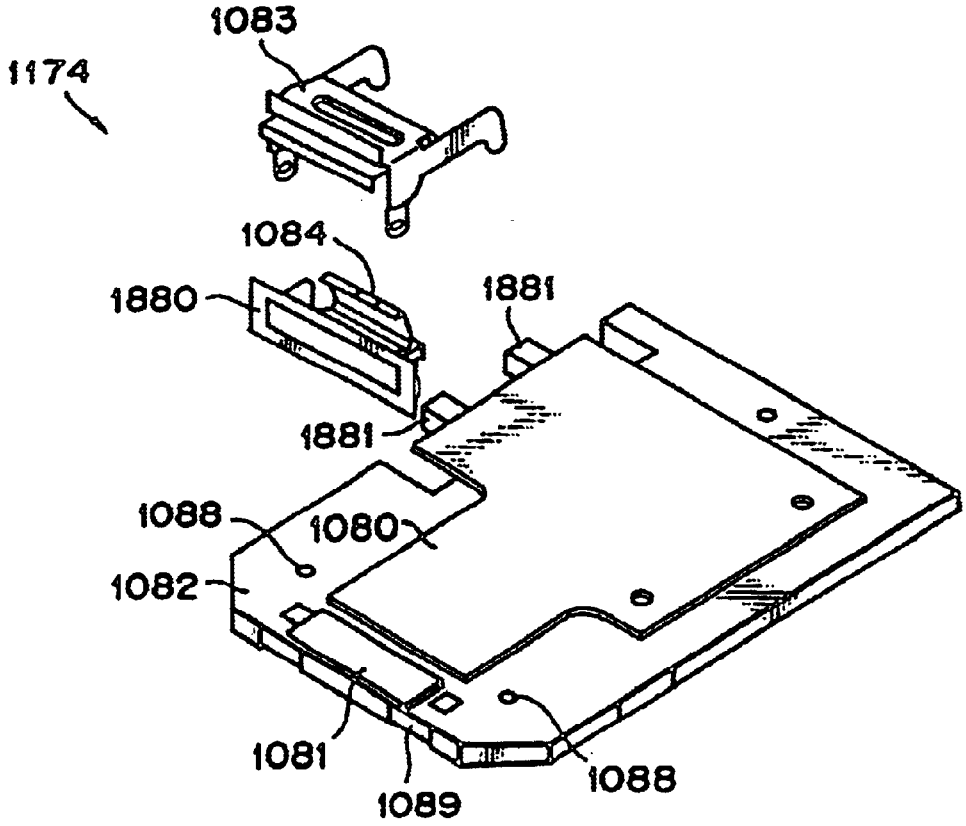
FIG. 7 is an exploded perspective view showing an example of construction of the ink-jet head applicable for the ink-jet printing system, to which the present invention is applicable.

FIG. 7 is an exploded perspective view showing the construction of one of the ink-jet head in the ink-jet head group 702. In FIG. 7, one end of a circuit board 1080 is mutually connected to a wiring portion of a heater board. On the other end of the circuit board 1080, a plurality of pads corresponding to respective electrothermal transducers are provided for receiving electric signal from the main body of the ink-jet printing apparatus. By this, the electric signal from the main body of the ink-jet printing apparatus is supplied to respective electrothermal transducers. A metal support having a back side surface supporting the circuit board 1080 forms a bottom plate of the ink-jet head unit. A depressing plate 1083 is adapted to exert an in-line resilient depression force for a region near an ink ejection orifice of a grooved top plate 1084 which is formed with a groove for forming the nozzle. The depression plate 1083 includes a portion formed by bending into substantially U-shaped configuration, a claw to be engaged with a clearance opening formed in a base plate, and a pair of rear legs receiving a force acting on a spring by the base plate. By this spring force, the circuit board 1080 is mounted with tightly fitted on the grooved top plate 1084. Mounting of the circuit board 1080 with respect to the metal support 1082 may be performed by bonding by means of a bond. A filter 1086 is provided at the end of an ink supply tube 1085. An ink supply member 1087 is formed by molding. The groove plate 1084 is integrally formed with an orifice plate 1880 and the ink passages for flowing the ink to respective ink supply opening. The ink supply member 1087 is fixed to the metal support 1082 by inserting two pins (not shown) extending from the back side of the ink supply member 1087 into two holes in the support 1082 and by thermal welding thereof. At this time, a gap between the orifice plate 1880 and the ink supply member 1087 is sealed. Furthermore, through the groove 1089 formed in the metal support 1082, a gap between the orifice plate 1880 and the front end portion of the metal support 1082 is completely sealed.

Figure 8:
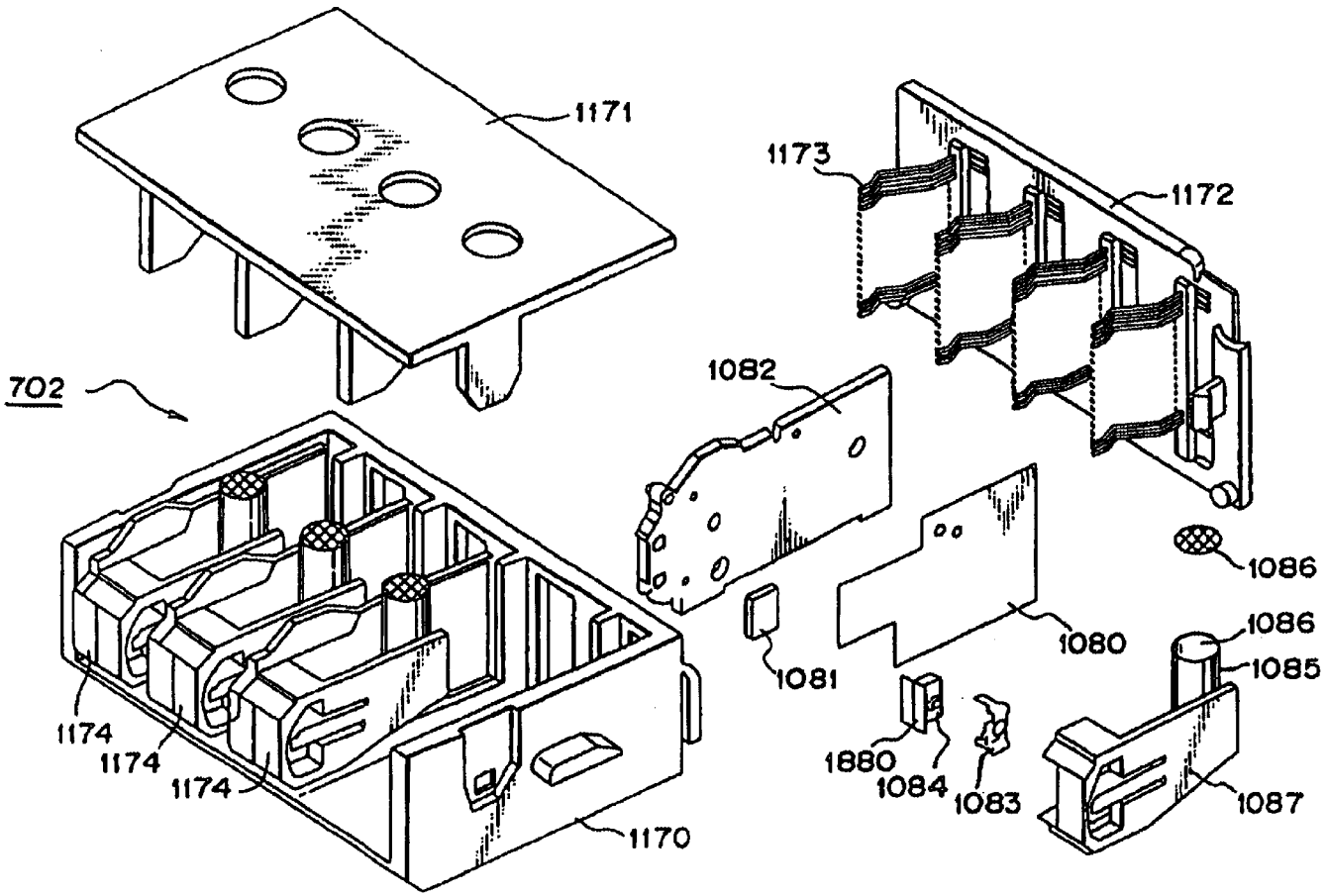
FIG. 8 is an exploded perspective view showing an example of construction of a head unit employing an ink-jet head of FIG. 7.

FIG. 8 shows a construction of a four head integrated ink-jet cartridge 702 in which four head units 1174 respectively capable of ejecting four color, i.e. cyan, magenta, yellow and black, inks, are integrally assembled with a frame 1170. Four ink-jet heads are mounted on the frame 1170 with a given intervals. Resist in a direction of ejection orifice array is adjusted. In the case, by performing adjustment using a mechanical reference plane of the ink-jet head, accuracy of dot forming position between respective colors is improved. It is also possible to further improve accuracy by actually performing ejection of ink with temporarily fixing the ink-jet head on the frame and directly adjusting the dot forming position on the basis of data of measurement of the position of the formed dot. The reference numeral 1171 denotes a cover of the frame, 1173 denotes a connector for connecting the pads provided on the circuit board 1080 of the four ink-jet heads and the main body of the ink-jet printing apparatus for receiving the electrical signal from the latter. Assembling four ink-jet head integrally is effective in improvement of accuracy of the dot forming position between the heads in addition to superiority in handling. It is also advantageous in reducing connection of signal lines between the ink-jet heads and the main body of the ink-jet printing apparatus. For instance, a signal line common to four ink-jet heads, such as GND line can be made common on a connection board 1172 to permit reduction of number of lines. Also, is possible to make a printing signal line common to respective ink-jet head by providing an integrated circuit board and driving the ink-jet heads in time sharing manner. Reduction of electrical connection is particularly effective for the apparatus having a large number of signal lines, such as color printing apparatus, high speed printing apparatus having a large number of ejection orifices.

Also, a typical ink to be employed in the shown embodiment of the ink-jet printing system is as follow, in which composition of the inks are shows in the order of black, cyan, magenta and yellow as ink (A), ink (B), ink (C) and ink (D). It should be noted that in the following disclosure, unless otherwise noted, % represents Wt %.

| | |
|---|---|
| Ink (A) Black | |
| (Solvent) | |
| triethylene glycol | 7.0% |
| hexanetriol | 7.0% |
| isopropyl alcohol | 1.5% |

-continued

| | |
|---|---|
| (Surface Active Agent) | |
| accetylene glycol added ethylene oxide (Tradename: Accethynol: Kawaken Fine Chemical K.K.) | 0.01% |
| (Dye) | |
| food black 2 | 3.0% |
| (Remainder) water | |
| Ink (B) Cyan | |
| (Solvent) Same as ink (A) | |
| (Surface Active Agent) same as ink (A) | |
| (Dye) direct blue 199 | 2.5% |
| (remainder) water | |
| Ink (C) Magenta | |
| (Solvent) Same as ink (A) | |
| (Surface Active Agent) same as ink (A) | |
| (Dye) direct red 227 | 2.5% |
| (Remainder) water | |
| Ink (D) Yellow | |
| (Solvent) Same as ink (A) | |
| (Surface Active Agent) same as ink (A) | |
| (Dye) direct yellow 86 | 1.5% |
| (Remainder) water | |

Figure 1:
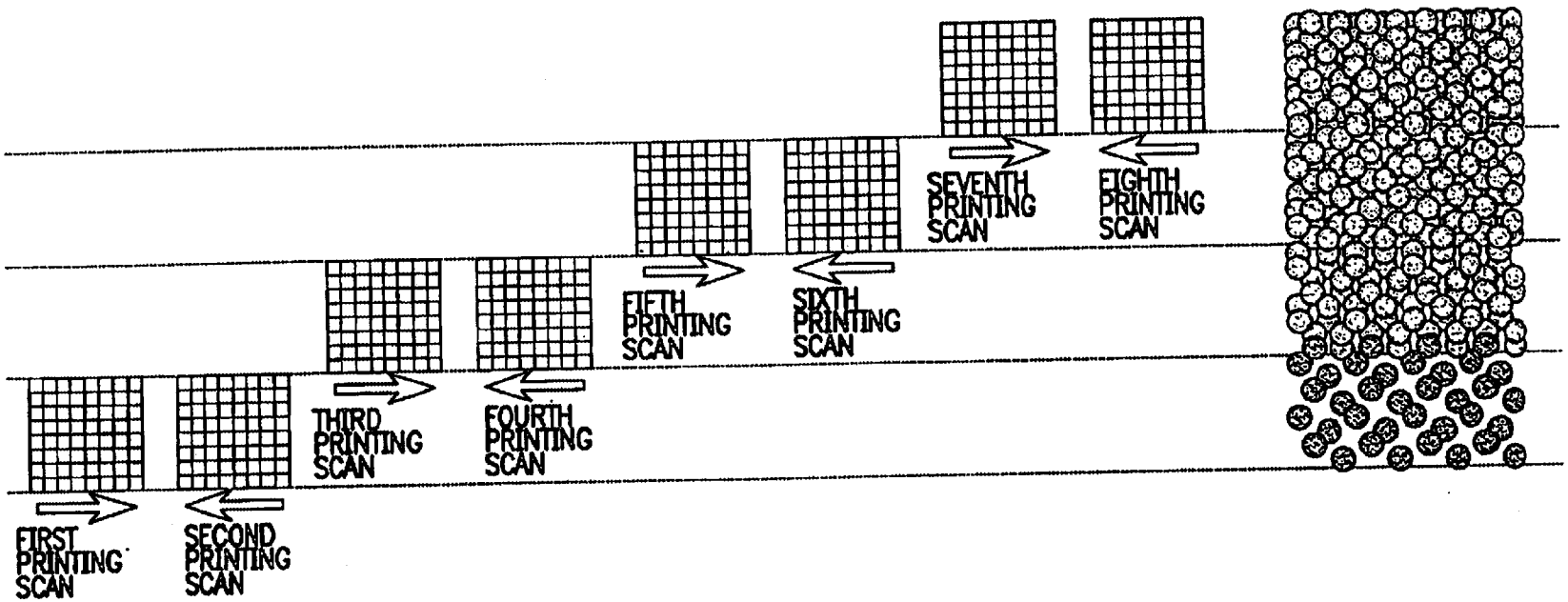
FIG. 1 is an explanatory illustration showing one embodiment of a cloth printing mode according to the present invention.

Next, operation in printing on the cloth according to the shown embodiment is illustrated in FIG. 1 and will be discussed in comparison with the typical printing operation for the plain paper or coated paper shown in FIG. 2. In the shown embodiment, according to the divided printing method set forth above, printing is completed by four times of multi-pass printing. In the shown embodiment, a cotton cloth is employed as the cloth.

Figure 2:
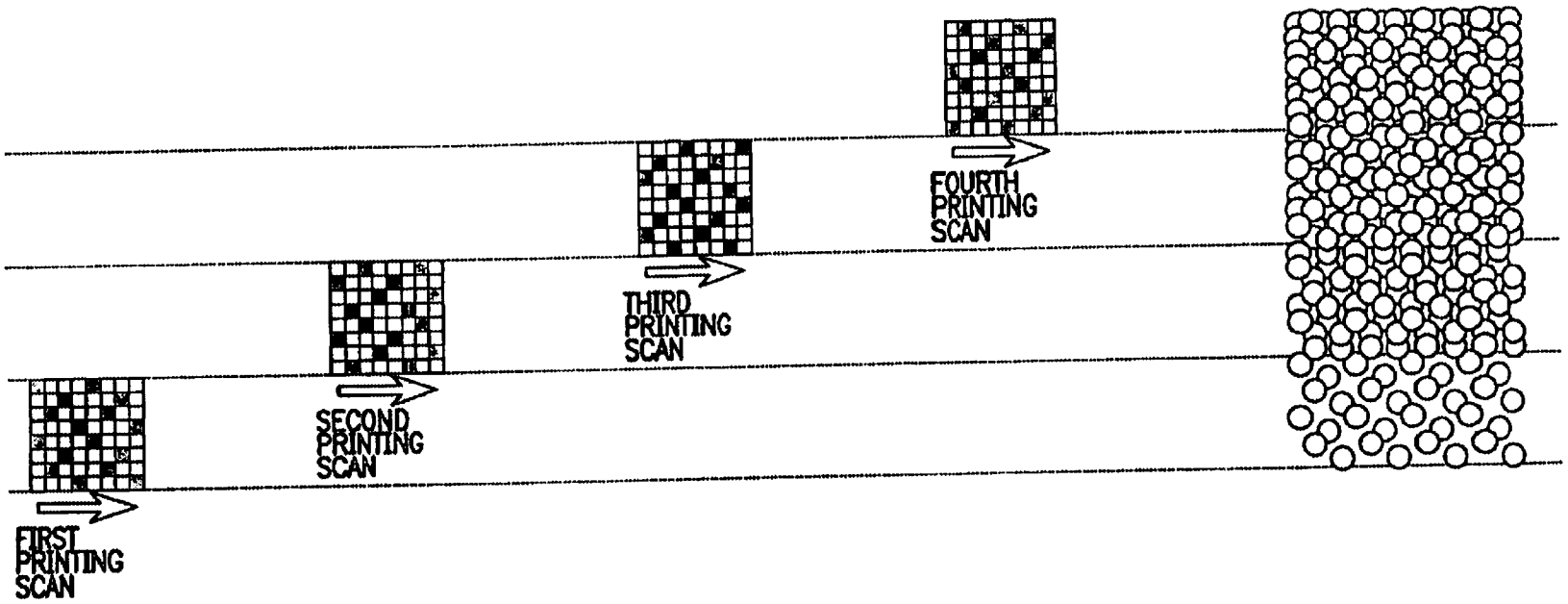
FIG. 2 is an explanatory illustration for a printing mode for a common paper and a coated paper in the one embodiment of the present invention.

FIG. 2 shows the case where printing is performed for the coated paper or the plain paper by the shown embodiment of the ink-jet printing apparatus. Number of the ejection orifices of the ink-jet head employed in the shown embodiment is 32. In the example shown in FIG. 2, printing is performed in one-way printing and feeding magnitude of the printing medium is set for 8 ejection orifices (=32/4). In each scanning cycle, printing is performed according to the print mask shown in FIG. 2. At every printing scanning cycle, the printing medium is fed for 8 ejection orifices. The first printing to the fourth printing are mutually complementary relationship so that printing scanning and feeding of the printing medium are repeated four times, printing for one divided region is completed. These print masks are preliminarily set in the apparatus, and upon printing, AND of the print mask data and the image data is taken as the actual printing data.

In contrast to this, FIG. 1 shows the condition of printing on the cloth. In this mode, printing of image is completed by eight times of printing scanning and four times of printing medium feeding. Namely, printing is performed by reciprocative printing scanning with pairs of first and second scanning cycles, third and fourth scanning cycles and so forth. In this manner, a common print mask is employed for a pair of scanning cycles, and each print mask is thinned into 25%. At the interval between the pair of scanning cycles, feeding of the printing medium is not taken place. By this, in sequence of two printing scanning cycles, i.e. the forward printing scanning cycle and the reverse printing scanning cycle, ink is ejected to print the same pixels. After series of forward and reverse scanning cycles, the printing medium is fed for a length corresponding 8 ejection orifices. Therefore, by eight scanning cycles, printing for one divided region can be completed.

In the process of FIG. 1 as set forth above, in comparison with the printing on the common paper as illustrated in FIG. 2, an amount of ink to be ejected becomes 200% of that for the common paper. Therefore, double of printing scanning cycles of that for the common paper becomes necessary. However, since the shown embodiment performs reciprocative printing, number of scanning of the carriage and period required for printing will become equivalent to that required in the printing for the common paper or the coated paper as illustrated in FIG. 2. On the other hand, even in FIG. 2, the period for printing may be shortened by performing second and fourth printing scanning in the reverse travel of the carriage. However, in case of the normal coated paper or the common paper, it can be the case of degradation of the printed image for the reason set forth above. In the ink jet printing apparatus shown in FIG. 5 and to be employed in the shown embodiment, the ink-jet heads for four colors are arranged in parallel to the direction of movement of the carriage, namely a primary scanning direction. Therefore, the order of ejection of the inks becomes reversed between the forward printing scanning and the reverse printing scanning. In such case, it has been known that color taste at the color mixing portion can be differentiated depending upon the order of ejections of the ink to the printing surface. Also, in the current available printing apparatus, it has been difficult to accurately control the dot forming portion in the forward printing scanning and the reverse printing scanning. Offset of the dot forming portion in the reciprocative printing is known to cause degradation of the printed rule, character and so forth. In order to avoid such problem, the normal printing mode is set for one-way printing as shown in FIG. 2.

By employing the above-mentioned printing method for cloth, it becomes possible to print high quality image even on the cloth similarly to the common paper, the coated paper or so forth. Furthermore, in case of cloth, because of large unevenness on the surface to be printed in comparison with the common paper and so forth and wider penetration and spreading area of the ejected ink, influence of variation of the color taste and the offset of the dot forming position is relative small even when reciprocative printing is performed. Therefore even with the conventional mechanism, reciprocative printing can be performed satisfactory. Accordingly, it is not necessary to add special mechanism for printing on the cloth and thus will not cause rising of the cost.

Embodiment 2

Figure 3:
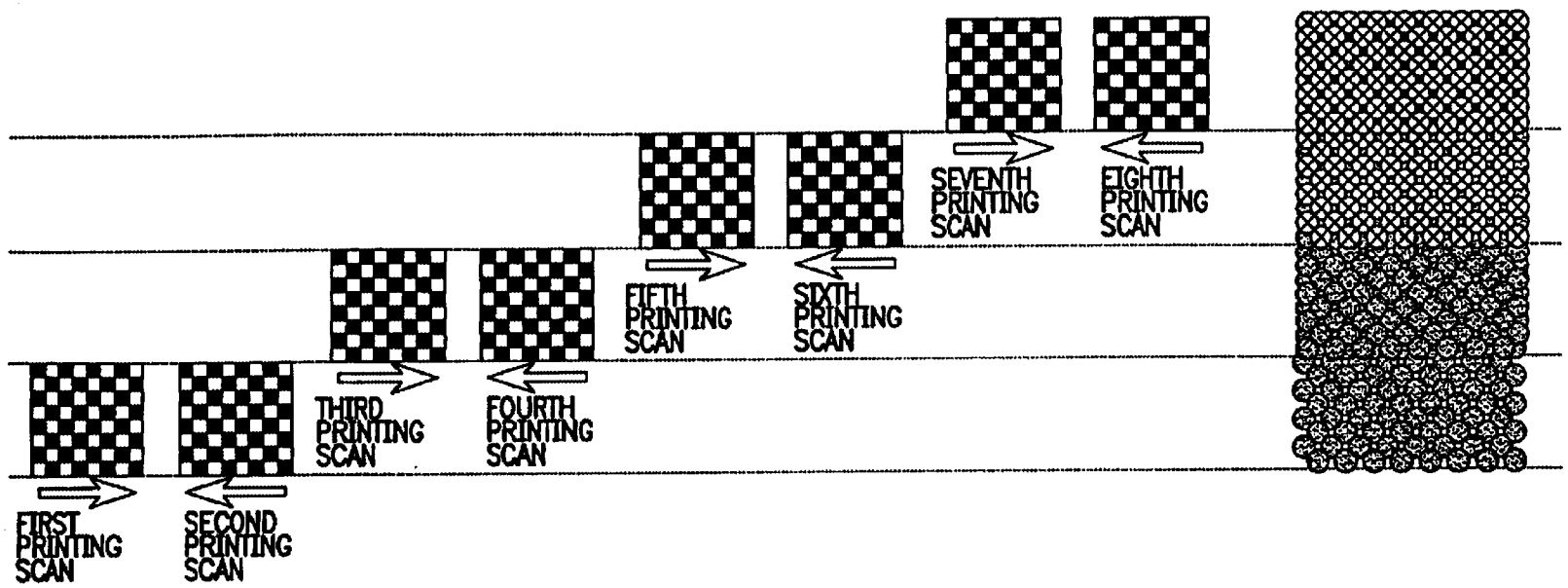
FIG. 3 is an explanatory illustration in a black emphasizing mode in cloth printing mode of the present invention.

FIG. 3 shows a printing mode, in which printing scanning is performed in the similar manner to that of FIG. 1 but ejection amount of the black ink is set to be larger, i.e. 400% than that of other color inks. In this mode, printing is performed on the cotton cloth similarly to the first embodiment.

Even in this embodiment, printing of image is completed by eight printing scanning cycles. However, the print mask to be employed for each printing scanning is thinned to be 50%. Namely, in the first, second, fifth and six printing scanning cycles as a group and in the third, fourth seventh and eighth printing scanning cycles as another group, respective the same print masks are employed to eject ink for the same pixel four times to achieve ejection of 400% in maximum amount of ink.

By setting ink ejection amount for respective colors, particularly by setting larger ink ejection amount for black, black color can be emphasized to obtain sharp image on the cloth. In general, as a visible image, the image can be seen sharper at higher density of black color for higher contrast. Accordingly, by the foregoing construction, sharpness of the printed image can be improved.

Embodiment 3

Figure 4:
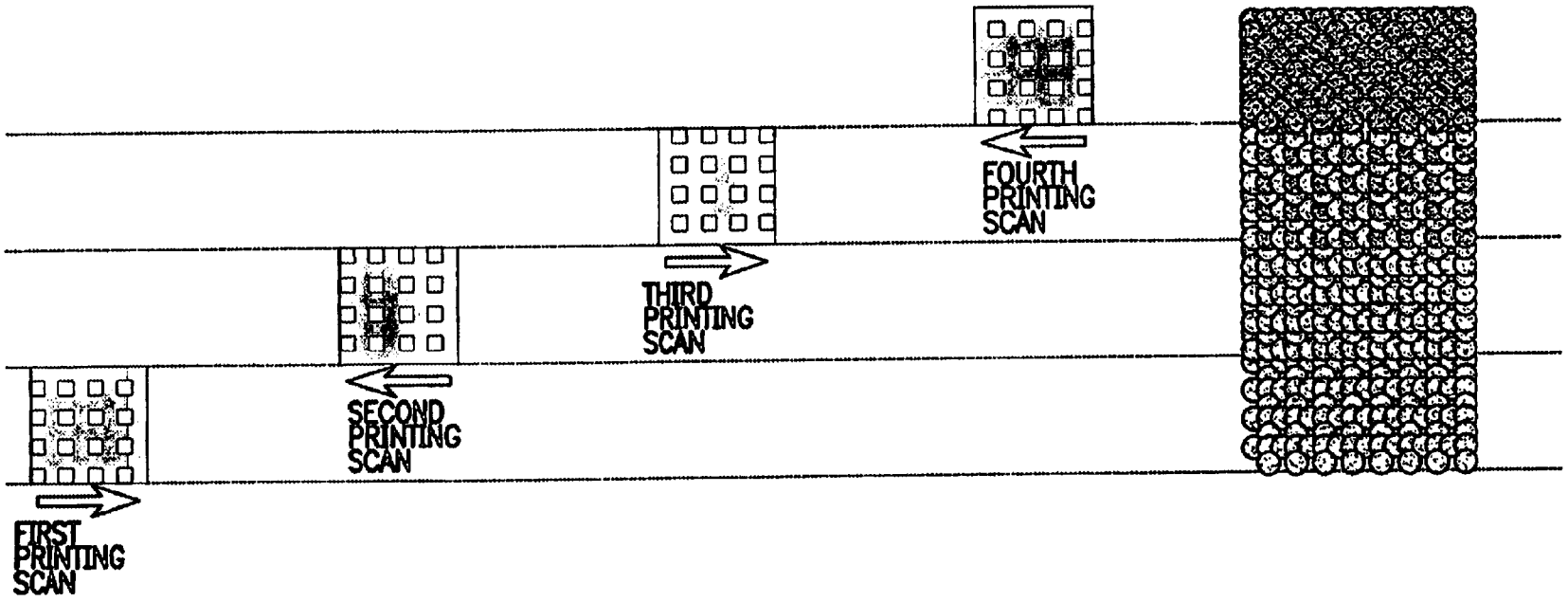
FIG. 4 is an explanatory illustration showing another embodiment of a cloth printing mode according to the present invention.

FIG. 4 shows the case where larger amount of ink is to be ejected for black in comparison with the ink ejection amount for other colors similarly to the second embodiment, and printing is to be performed for thinner cloth. In this case, when 400% of ink is ejected similarly to the second embodiment, the ejected ink may reach the back side of the cloth to possibly exceed an ink reception capacity of the cloth. This may cause bleeding at the boundary between the black and other colors. Also, it is possible to cause stain of the printing apparatus due to the ink reaching the back side, which, in turn, causes stain on the cloth fed for next printing. Also, when large amount of ink is ejected, the volume of the cloth at the portion where the large amount of ink is ejected to possibly cause cockling of the cloth printing medium. Accordingly, the ink ejection amount is adjusted to be 300% to avoid such problem.

In the embodiment shown in FIG. 4, printing is completed by four printing scanning cycles in reciprocal printing. The print mask to be used in each printing scanning cycles is thinned to be 75%. By performing scanning employing the print mask shown in FIG. 4, 300% of ink ejection is achieved by ejecting ink for maximum three times for the same pixel.

Even when such ink ejection amount is set as set forth above, forth the cloth employed in thin, the printed image may not be degraded in comparison with that printed by the second embodiment, and the black color can be sufficiently emphasized to express the clear image. In addition, by appropriately limiting the ink amount, cockling of the cloth can be successfully prevented, and thus damaging of the ink-jet head due to cockling of the cloth and other problems can also be avoided.

It should be noted that respective print masks set forth above are mere examples and any mask pattern is applicable as long as an appropriate ink ejection amount can be achieved.

Embodiment 4

As ink to be employed in the ink-jet printing apparatus according to the present invention, an ink adjusted the content of the surface-active agent is less than critical micell concentration versus ink and greater than the critical micell concentration versus water is employed. Here, black, cyan, magenta and yellow inks are shown in the following table as ink(E), ink(F), ink(G) and ink(H).

| Ink (E) Black | |
|---|---|
| (Solvent) | |
| glycerin | 7.5% |
| thiodiglycol | 7.5% |
| (Surface Active Agent) | |
| accetylene glycol added ethylene oxide (Tradename: Accethynol EH: Kawaken Fine Chemical K.K.) | 1.0% |

-continued

| | |
|---|---|
| (Stabilizer) | |
| urea | 7.5% |
| (Dye) | |
| food black 2 | 4.0% |
| (Remainder) water | |
| Ink (F) Cyan | |
| (Solvent) Same as ink (E) | |
| (Surface Active Agent) same as ink (E) | |
| (Stabilizer) same as ink (E) | |
| (Dye) direct blue 199 | 3.5% |
| (remainder) water | |
| Ink (G) Magenta | |
| (Solvent) Same as ink (E) | |
| (Surface Active Agent) same as ink (E) | |
| (Stabilizer) Same as ink (E) | |
| (Dye) direct red 227 | 3.5% |
| (Remainder) water | |
| Ink (H) Yellow | |
| (Solvent) Same as ink (E) | |
| (Surface Active Agent) same as ink (E) | |
| (Stabilizer) Same as ink (E) | |
| (Dye) direct yellow 86 | 2.5% |
| (Remainder) water | |

Figure 9:
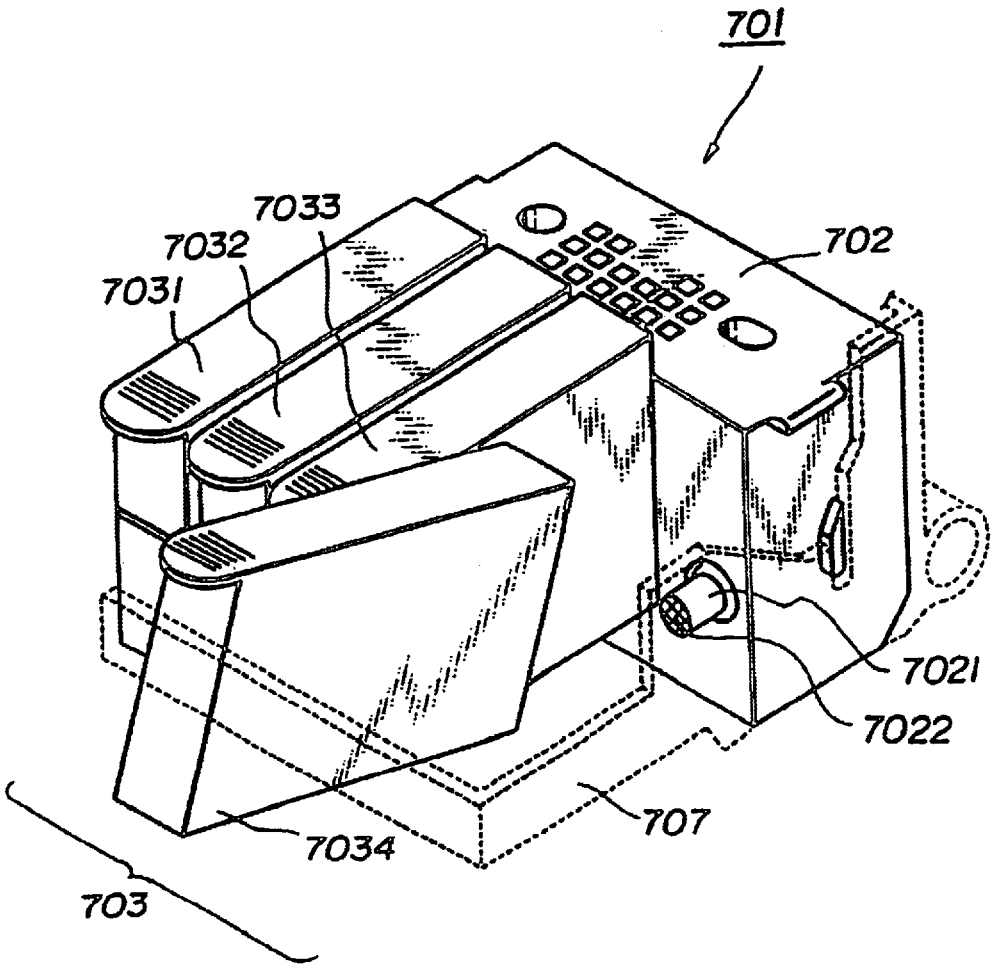
FIG. 9 is a perspective view showing the head unit of FIG. 8 and a separation type tank to be installed in the head unit.

These inks are stored in the four ink tanks in the ink tank group 703 per each color as shown FIG. 5 are replaced with the ink tank group in the first embodiment. Here, exchanging means of the ink tank is shown in FIG. 9. In FIG. 9, the reference numeral 701 denotes a head cartridge employing four ink-jet heads, which comprises the ink-jet head group 702 and four ink tank 7031, 7032, 7033 and 7034. Ink supply tube are provided for respective ink-jet heads. In FIG. 9, the ink supply tube for one color is shown with identification by the reference numeral 7022. Also, the four ink tank 7031 to 7034 are arbitrarily exchangeable. At the installed position, the ink tanks 7031 to 7034 are coupled with the ink-jet head 702 by an engaging guide and a pressurizing means provided on the carriage. The ink tank cartridges 7031 to 7034 house ink holding member formed with porous body therein 30 that ink may be satisfactorily supplied by compressing together with a filter 7021 provided at the tip end of the supply tube. When ink tank is just set by exchanging operation or so forth, by means of a sucking recovery pump (not shown) for the ink-jet head provided in the main body of the ink-jet printing apparatus, inks are forcedly supplied to respectively corresponding ink-jet heads from the newly installed ink tank 7031 to 7034 to fill respective ink-jet heads.

By applying such exchangeable ink tank for the printing apparatus, the ink can be exchanged to arbitrary kind of ink. Also, even when the kinds of the inks for use are fixed, ink can be supplemented instantly when consumed.

With employing such ink-jet printing system, printing operation was performed for a hemp cloth by the printing method of FIG. 1. Hemp has low hygroscopic characteristics in comparison with the cotton employed in the first embodiment. The ink employed in this embodiment, however have high penetration characteristics as set forth above. Therefore, the printed image did not have degradation of the image, such as bleeding or so forth, and thus was satisfactory similar to the first embodiment.

Embodiment 5

Among four kinds of inks employed in the foregoing fourth embodiment, only black ink is replaced with an ink (I) which does not contain surface-active agent and has the following composition.

| Ink (I) Black | |
|---|---|
| (Solvent) | |
| glycerin | 5.0% |
| thiodiglycol | 5.0% |
| isopropyl alcohol | 4.0% |
| (Stabilizer) | |
| urea | 5.0% |
| (Dye) | |
| food black 2 | 3.0% |
| (Remainder) water | |

Employing the foregoing composition of ink and providing greater area for the ejection orifice only for the ink-jet head used for ejecting black ink so that the ink ejection amount of the black ink becomes double of the ink ejection amount of other color ink, certain attention is paid for emphasizing block. In concrete, in the ink-jet head having the ejection orifices arranged for 360 dpi, the ink ejection amount of the black is set at 80 ng/dot and the ink ejection amount of other colors, i.e. cyan, magenta and yellow is set at 40 ng/dot. Under the same condition to the first embodiment, except for the ink ejection amount, printing operation was performed. Employing the ink containing no surface-active agent for black, may be applicable for printing giving importance for character quality in black and printing density thereof.

Namely, as set forth above, the ink containing the surface-active agent has good ink penetration characteristics. This is advantageous in prevention of bleeding at the boundary of the colors and improving throughput in printing. Therefore, the ink containing the surface-active agent is suitable for cloth printing for large amount of ink to be ejected. However, in comparison with the ink which does not contain the surface-active agent, such as ink (I), the ink can spread in circle at relatively wide area on the cloth, it cannot be desirable in view of resolution of the rule, character and so forth.

In such case, by employing the ink prepared with giving importance for printing density and resolution of black, such as that of the shown embodiment, and appropriately selecting the ejection amount, excellent image can be printed on the cloth.

Even in printing on the printing medium other than cloth, it is typical to seek for prevention of the bleeding at the color boundary in the colors other than black and for higher density and resolution for black. Similarly, in printing on the cloth, it can be easily expected that high density and high resolution is required in cloth printing. Particularly, in cloth printing, greater depth (higher density) of black is frequently required. In such case, by employing the ink with limited penetration speed, the ink amount to be penetrated can be compensated. In this case, by taking the construction to have the ink ejection amount 80 ng/dot for black and the ink ejection amount 40 ng/dot for cyan, magenta and yellow, desired high density and high resolution can be achieved in cloth printing.

Also, when two or more kinds of inks are employed as in the shown embodiment, it sometimes causes difficulty to place different kinds of inks at adjacent positions for the property of the inks. In such case, unless a special printing method is employed, the inks repulse to each other at the boundary to cause blurring. However, in case of cloth printing, absorption to the regularly arranged fiber may be preferentially caused, such problem will be arisen even without such special measure Embodiment 6

In this embodiment, description will be given for a printing employing the reactive dye as coloring material for enhancing effect of the textile printing image in the cloth printing. The reactive dye to be employed in the present embodiment is a water-soluble dye, such as azo type, anthoraquinon type, phthslocyaninc type dyes or so forth, which has been widely employed in coloring of fiber or conventional textile printing method. These reactive dye contains water-soluible group, such as sulfonate group, carboxyl group and so forth, and also contains a group, such as dichlortriazine group, monochlortriazine group, trichlorpyrimidine group, monochlordifluoropyrimidine group, chlorbenzthiazole group, dichlorpyridazon group, dichlorquinoxaline group, epoxy group, 3-carboxypyridiniotriazine group, —$SO_2CH_2CH_2OSO_3H$, —$SO_2NHCH_2CH_2OSO_3H$, —$NHCOCH_2CH_2OSO_3H$, —$NHCOCH_2CH_2Cl$, NHCOCH=$CH_2$, —$SO_2CH$=$CH_2$, —$CH_2NHCOCL$=$CH_2$, NHCOCBr=$CH_2$, —$NHCOCH_2CL$, —$NHCH_2OH$, —PO3H and so forth.

As concrete example, the following inks (J) to (M) can be considered.

| | |
|---|---|
| Ink (J) Black | |
| (Solvent) | |
| tiodiglycol | 24.0% |
| diethylenegylcol | 11.0% |
| (Dye) | |
| C.I. reactive black 39 | 10.0% |
| (Remainder) water | |
| Ink (K) Cyan | |
| (Solvent) Same as ink (J) | |
| (Dye) C.I. reactive blue 72 | 10.0% |
| (remainder) water | |
| Ink (L) Magenta | |
| (Solvent) Same as ink (J) | |
| (Dye) C.I. reactive red 24 | 10.0% |
| (Remainder) water | |
| Ink (M) Yellow | |
| (Solvent) Same as ink (J) | |
| (Dye) C.I. reactive yellow 85 | 10.0% |
| (Remainder) water | |

The ink employing these reactive dyes (this ink will be hereinafter referred to as "reactive ink") are stored in the ink tanks for respective colors in the ink tank group 703. Then, respective ink tanks are coupled with respectively corresponding ink-jet heads in the ink-jet head group 702. Then, the printing mode is set at the cloth printing mode. As the cloth to be printed, silk with alkali treatment in the known manner is prepared for performing printing operation. The cloth, for which printing is completed, is subject wet heating process at 102° C. for 8 minutes in a temperature managed steamer to cause reaction between dye and —OH group in the fiber. Thereafter, by washing the non-reacted dye by water, printed product can be obtained. The printed product obtained the process set forth above was satisfactorily clear.

Embodiment 7

As a modification of the ink-jet printing apparatus set forth above, discussion will be given for the construction of an ink-jet printing apparatus illustrated in FIG. 10. The construction in the shown embodiment is constructed by providing two-stage construction of the ink-jet head cartridge of the ink-jet printing apparatus of FIG. 5. With the shown embodiments a series of printing scanning operations for completing image printing as discussed in the first to sixth embodiments are taken as first stage. After completion of the first stage process, feeding of the printing medium is performed for several times. Then, for the printing region to be further completed, second stage printing scanning is performed by the ink-jet head 1301 At this time, in both of the first and second stages, it may be possible to perform or not perform the foregoing multi-pass printing. In such case, the ink ejection amount may be distributed between the first stage and second stage. For instance, when the ink ejection amount is set to be 200%, the first stage printing is performed for 100% of ink ejection amount and the second stage printing is performed for another 100% of ink ejection amount.

In such case, in the firs t stage printing, the first stage ink-jet printing head ejects inks of black, cyan, magenta and yellow, and in the second stage printing, the second stage ink-jet printing head ejects inks of black, red, green and blue. With the construction set forth above, due to mixing with the cyan, magenta and yellow, the red, green and blue which always requires double of the ink ejection amount can be treated at the equivalent amount to other four colors. Therefore, the ink ejection amount for the overall image can be made uniform Furthermore, with the shown embodiment, since the second stage printing can be performed after progressing drying through printing scanning and printing medium feeding for several times, it becomes possible to elevate printing image density and prevention of bleeding between adjacent colors. Also, at the color mixing portion, since the ink amount to be simultaneously printing can be made smaller, excessive penetration of the ink can be avoided. The shown construction of the embodiment becomes suitable for cloth printing.

Also, in the former embodiment, since printing is performed by only first stage printing, it is possible to cause connecting band at over eight ejection orifices. However, in the shown embodiment, since the second printing stage is added, it becomes possible to set the connecting portion of the second stage printing at different position to that of the first stage printing. By this, solution can be provided for the problem of connection band in the multi-pass printing.

Figure 10:
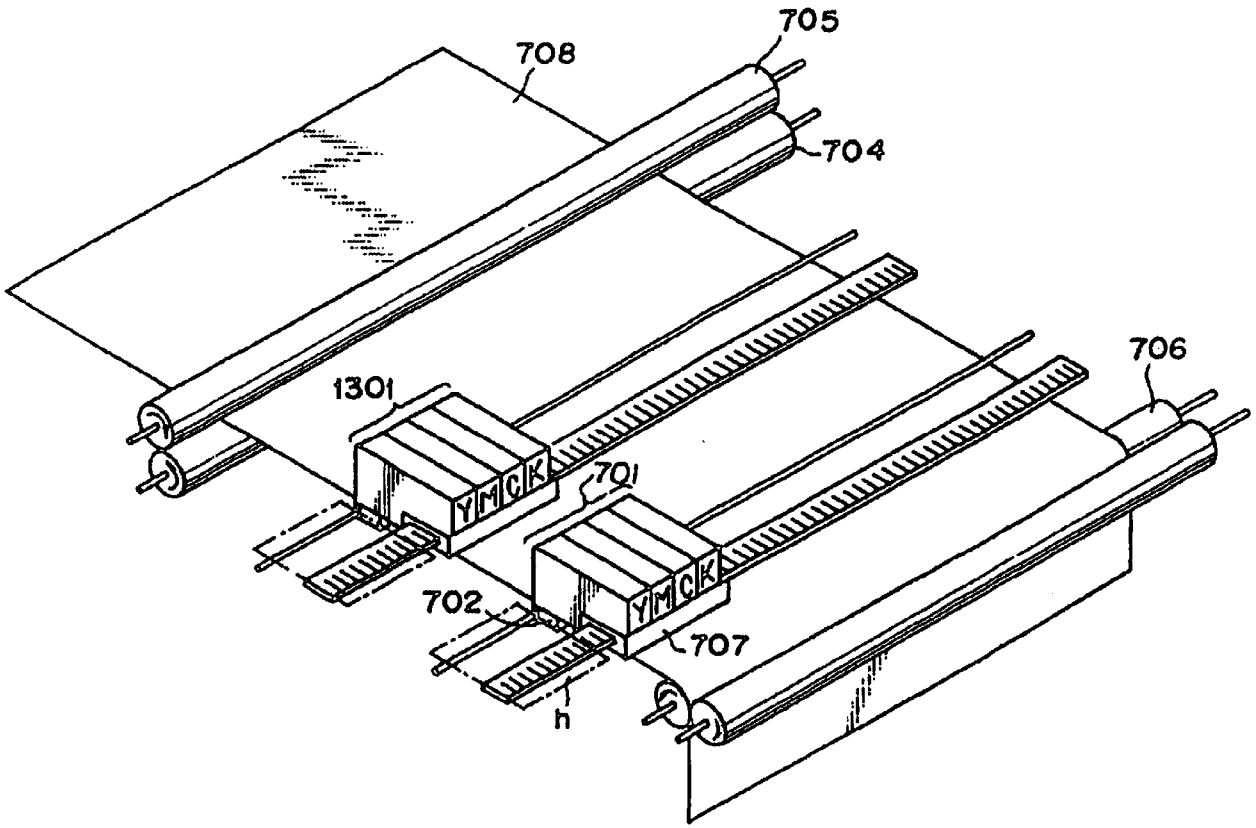
FIG. 10 is a diagrammatic perspective view showing another example of the construction of the printing portion in the ink-jet printing system, to which the present invention is applicable.

As set forth above, by the shown embodiment, employing the ink-jet printing apparatus constructed as illustrated in FIG. 10, and by setting respective printing modes set forth above as one of the printing modes, freedom in cloth printing can be increased.

It should be noted that even in the shown embodiment, the construction disclosed in Japanese Patent Application No. 164845/1993 and Japanese Patent Application No. 108226/1993 can be applied similarly to the former embodiments. Application of the construction in the above-identified co-pending applications are effective for achieving the task of the invention.

Embodiment 8

Figure 11:
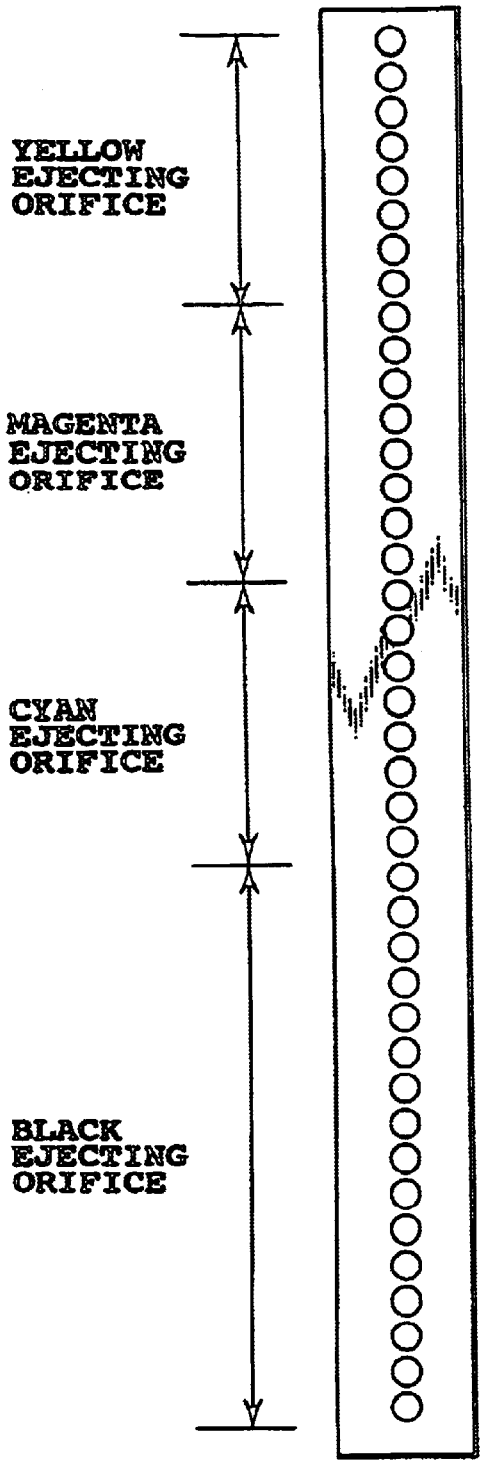
FIG. 11 is an explanatory illustration showing another example of an ink-jet head to be employed in the ink-jet printing system, to which the present invention is applicable.
Figure 12:
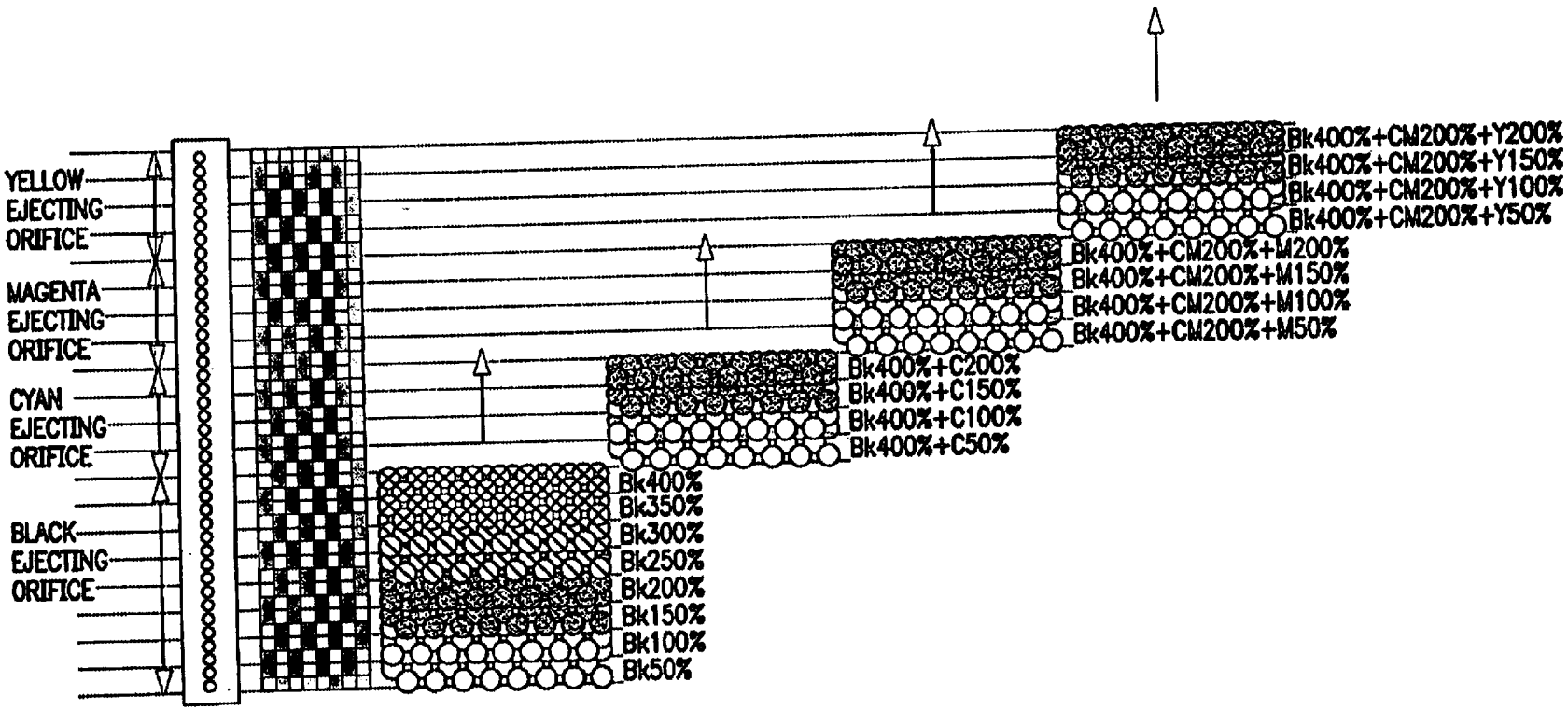
FIG. 12 is an explanatory illustration showing one embodiment of a cloth printing mode in the case where the ink-jet head shown in FIG. 11 is employed.

While the foregoing embodiments are discussed in terms of the arrangement of the ejection orifices for ejecting respective colors of inks along the primary scanning direction, it is possible to employ the ink-jet head, in which the ejection orifices are aligned along a direction of an auxiliary scanning line, as shown in FIG. 11. The shown ink-jet head has sixteen ejection orifices for black, and respective eight ejection orifices for respective of cyan, magenta and yellow. Each color of ejection orifices are align vertically in parallel relationship to the those of other colors. FIG. 12 shows the printing condition in the cloth printing mode when such ink-jet head is employed. In the show embodiment, similarly to the second embodiment, 50% thinning mask is employed, and by repeating printing medium feeding for a length corresponding two ejection orifices, 400% of ink is ejected for black through eight reciprocative scanning and 200% of ink is ejected for cyan, magenta and yellow through four reciprocative scanning Therefore, image printing is completed per colors. In FIG. 12, the condition where ink for one dot is ejected (100% of ink is ejected) is shown by hollow circle, the condition where ink for two dots is ejected (200% of ink is ejected) is shown by solid circle, the condition where in for three dots is ejected (300% of ink is ejected) is shown by hatched circle, and the ink for four clots is ejected (400% of ink is ejected) is shown by x.

When the ejection orifices are arranged in the vertical direction (auxiliary scanning direction, namely the feeding direction of the printing medium) as in the shown embodiment, in the case that the printing is performed in the printing made in which 100% of ink is ejected and which differs from the cloth printing mode, there are method to set the printing medium feeding magnitude to be double with maintaining the print mask as is or to employ the print mask with the thinning rate for 25%. Also, when emphasizing of black is not effected, it is not possible to make adjustment by the printing medium feeding magnitude. Therefore, the thinning rate only for black is decreased to be half or to reduce the number of the ejection orifices to actually perform ink ejection by signal.

In the shown embodiment, since it takes the construction to overlay each colors sequentially, prevention of bleeding between the different colors can be facilitated. Also, since ink amount to the ejected simultaneously at the color mixing portion becomes smaller, excessive penetration of the ink can be prevented. Therefore, the construction of the shown embodiment is suitable for the cloth printing.

As set forth above, according to the shown embodiment, by employing the ink-jet head constructed as illustrated in FIG. 11 and setting the printing method for ejecting larger amount of ink than that in normal printing shown in FIG. 12 as one of the printing mode of the ink-jet printing apparatus, appropriate density and image quality can be obtained equivalent to printing on the common paper, the coated paper or the OHP film simply by selecting the printing mode adapted to cloth printing.

It should be noted that even when such form of ink-jet head is employed, switching of the printing mode and changing of the kind, of ink and so forth as set forth with respect to the former embodiment, are equally applicable.

Embodiment 9

Figure 13:
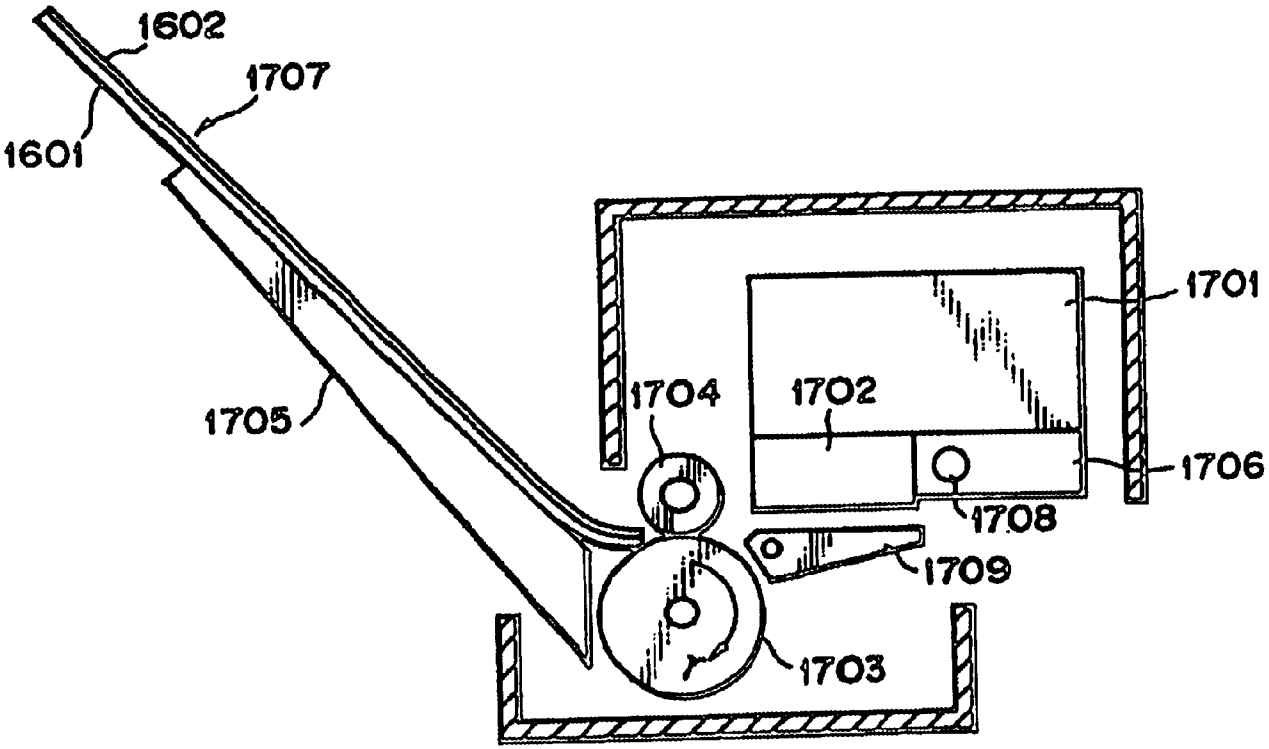
FIG. 13 is a diagrammatic sectional side elevation showing a printing portion in the ink-jet printing system capable of automatic setting of the printing medium, to which the present invention is applicable.

FIG. 13 shows an example of the construction of the printing portion in the ink-jet printing system which permits automatic loading. Also, when the shown system is employed, the construction of the cloth printing medium and the method of performing textile printing by way of ink-jet printing are respectively shown in FIGS. 14 and 15.

Figure 14:
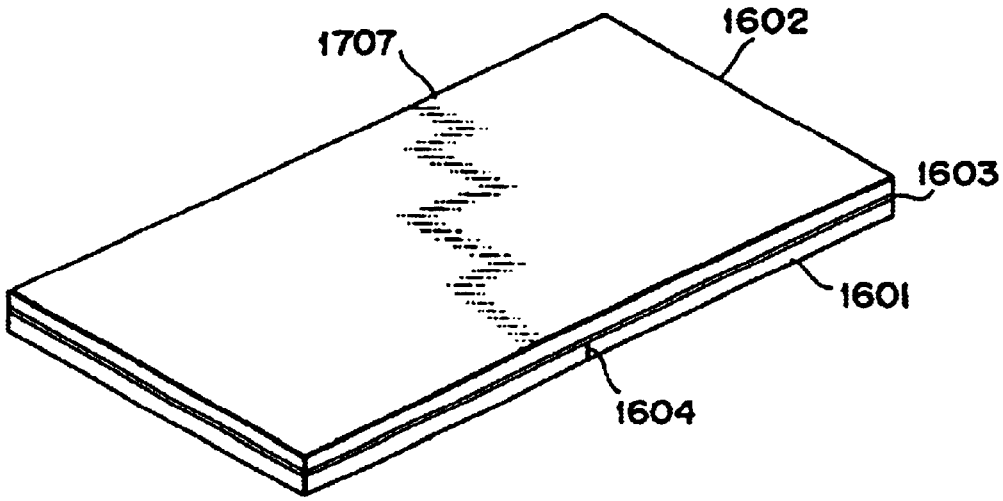
FIG. 14 is a perspective view showing one example of construction of a printing cloth in a form of a cut sheet, to which the present invention is applicable.
Figure 15:
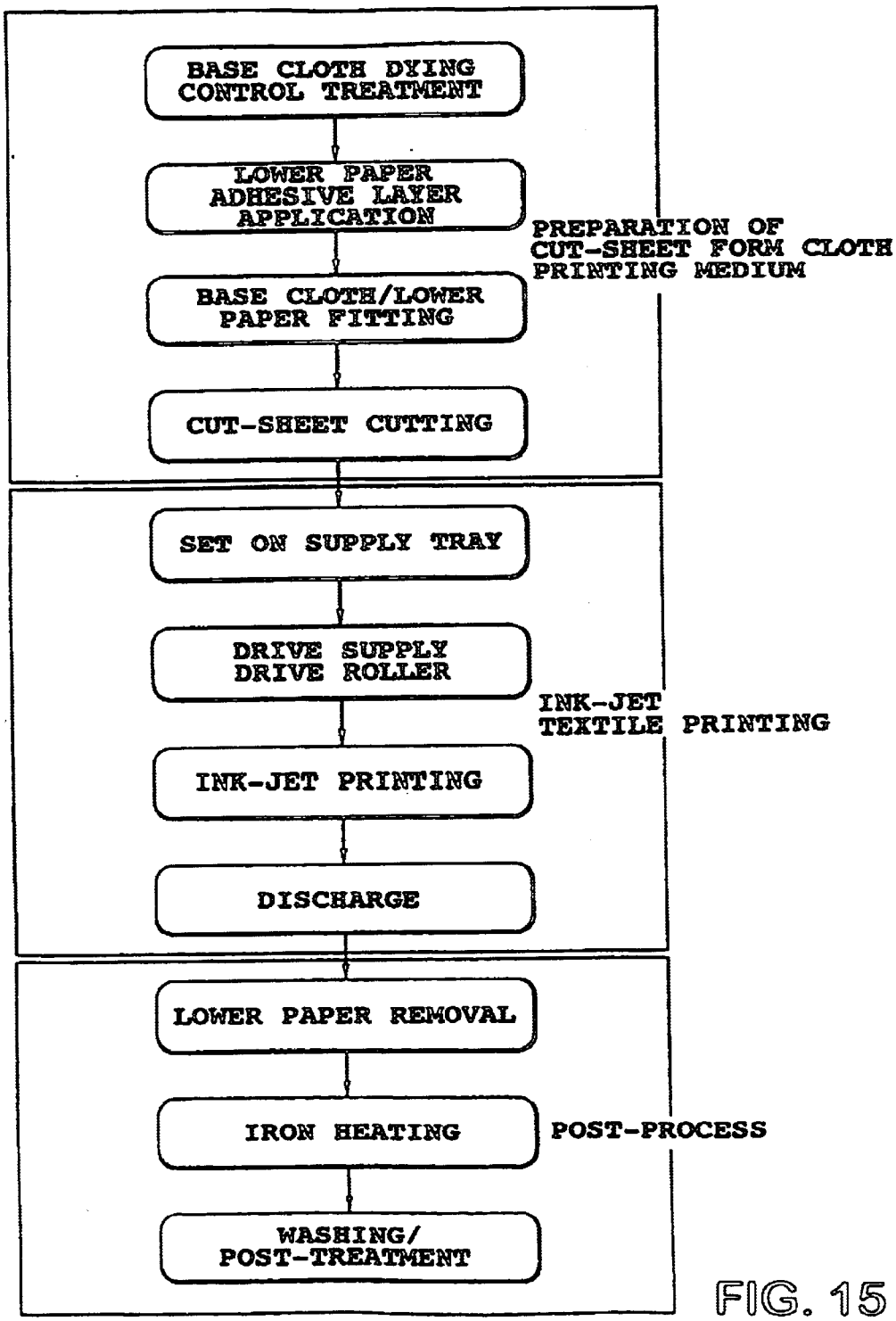
FIG. 15 is a block diagram illustrating a method for performing printing employing the cut-sheet form printing cloth shown in FIG. 14.

The shown embodiment of the ink-jet textile printing method will be discussed with reference to FIGS. 13, 14 and 15. There is prepared cut-sheet form cloth printing medium 1707 formed by adhering a base cloth which is preliminarily processed by preparatory process (ink dying control treatment) adapted to the ink of the ink-jet printing, on a common paper (lower paper) which has an adhesive layer having ink absorbing ability and easy to peel off. The foregoing process is referred to as "cloth medium preparation" in FIG. 18. The cloth printing medium 1707 is set at the upstream side in a transporting direction of a transporting roller pair (a transporting drive roller 1703 and a transporting driven roller 1704) as a transporting means for the printing medium in the ink-jet printing apparatus. Then, preparation for ink-jet textile printing is performed, in which recovery operation of the ink-jet head and setting of the image data and so forth are performed. Upon initiation of textile printing, the transporting drive roller 1703 and the transportation driven roller 1704 driven by the former start rotation. Since the cut-sheet form cloth printing medium is in contact with the transportation drive roller 1703 at the tip end, the cut-sheet form cloth printing medium is drawn into the transporting roller pair. Therefore, the cut-sheet form cloth printing medium 1707 can be automatically installed in the transporting means. At this time, the surface of the cut-sheet form cloth printing medium contacting with the transporting drive roller is the lower paper side 1601 of the common paper which is normally employed in the ink-jet printing apparatus. Therefore, stable transportation can be achieved.

Since the cloth printing medium 1707 is constructed by adhering the base cloth 1602 contacting with the transporting driven roller at the printing surface, on the ink absorptive adhesive layer 1603 of the common paper 1601, stable transportation of the lower paper by the transportation drive roller may provide transportation ability permitting fine and precise printing by ink-jet printing. Also, as set out above, in synchronism with transportation of the cut-sheet form cloth printing medium, an ink-jet printing portion provided on the transporting path is operated to perform printing (textile printing) on the base cloth of the cut-sheet form cloth printing medium ("ink-jet textile printing" in FIG. 15). After completion of printing, the textile printing cut-sheet form cloth printing medium discharged from the ink-jet printing apparatus is subject natural drying. Thereafter, through heating process if required, fixing process for the dye is performed. Thereafter, the lower paper is removed and the ink-jet printed base cloth is subject to the washing process and then dried by nature drying again. Through these process, the cut-sheet form textile printed cloth is obtained ("post-process" in FIG. 15).

The base cloth 1602 in the shown embodiment is the cloth of cotton 100%. In the shown embodiment, upon cutting and processing the cotton 100% material cloth into the cut-sheet form, the cut-sheet form base cloth is formed into a rectangular configuration having respective edges substantially along warp and weft of the cloth for stability of transportation in contacting with the transporting driven roller, for facilitating texture management (discrimination of vertical and lateral clothes) and further for optimizing cutting to obtain maximum number of cut-sheet form base cloth from the material cloth.

Subsequently, discussion will be given for concrete treatment for the cut-sheet form cloth printing medium. At first, dying control treatment for the base cloth is performed for the base cloth 1602 employing a treatment liquid (P) prepared depending upon the ink. In the process, the treatment liquid (F) is impregnated in the base cloth 1602 by means of a chimmer type textile printing machine with solid pattern screen of 100 mesh. Then, the base cloth is dried at 100° C. for 2 minutes. Here, the ink having the composition of the sixth embodiment was used. The adhesive layer is formed with employing a treatment liquid (Q) and uniformly applying the liquid by doctor knife coater on the common paper 1601. While it depends on the thickness of the base cloth and the ink ejection amount upon ink-jet textile printing, in order to absorb the ink not absorbed by the cloth and bleeding therefrom and thereby prevent unexpecting spreading of the ink, it is desirable that the adhesive layer 1603 has high ink absorption ability. The base cloth completed the dying control treatment is adhered with the common paper having the adhesive layer. Adhering of the base cloth and the plain material is performed by pressing using a pair of rubber rollers heated at 80° C.

| Treatment Liquid (P) | |
|---|---|
| urea | 10% |
| sodium bicarbonate | 3% |
| sodium methanitrobenzen sulphonate | 1% |
| water | 86% |
| Treatment Liquid (Q) | |
| polyvinyl alcohol | 20% |
| water | 80% |

Subsequently, the cloth printing medium thus prepared is cut by a slit cutter along the texture. however, when an angle between the texture and the cut edge can be maintained constant and can be easily discriminated, it is possible to cut the cloth in oblique, e.g. 45° C. to the texture. In the shown embodiment, at the time of cutting or before or after cutting, cut line 1604 is provided for the common paper for ease of removal of the common paper after textile printing. In order to obtain the equivalent effect, it is possible to provide a portion of the common paper where the adhesive layer is not provided so that non-adhered portion is left after adhering of the base cloth with the common paper in the extent not to degrade transporting ability. Through the process set forth above, the cut-sheet form cloth printing medium is prepared.

In the shown embodiment, with respect to the 100% cotton cloth, transporting ability was tested with adjusting clark stiffness by varying the basis weight and papering direction. When transporting test is performed with the cut-sheet form cloth printing medium having the clark stiffness 8 obtained by employing a light weight paper having the basis weight less than or equal to 20 g/cm$^2$ as the lower paper and adhering along the lateral texture having smaller stiffness, oblique transportation and puckering was occurred frequently and occurrence of failure associating with transporting ability is unitarily high at 48/50. Therefore, it is judged that this cut-sheet form cloth printing medium is not suitable for practical use In contrast, when the cut-sheet form cloth printing medium having the clark stiffness 12 obtained by adhering the above-mentioned light weight per in longitudinal texture having higher stiffness, transportation failure was significantly reduced to be 10/50. Furthermore, the failure caused at this time was slight oblique travel but not critical failure, such as puckering, was not caused. Also, when the cut-sheet form cloth printing medium prepared with a light weight paper having the basis weight of 38 g/cm$^2$ adhering in lateral and longitudinal textures had the clark stiffness of 20 and 39, respectively. In either case, no transportation failure was cause and excellent transporting ability was obtained. From this, it has been found that stability transportation and capability of automatic loading in the ink-jet printing apparatus can be achieved by adhering the base cloth having small stiffness with the lower paper to increase the stiffness to be higher than or equal to 10 in clark stiffness. The upper limit and lower limit of the clark stiffness should depend on the construction of the ink-jet printing apparatus. However, it is preferred to be less than or equal to 400, more preferably greater than or equal to 20 and smaller than equal to 300. Therefore, the adhesive layer and the lower paper are to be selected depending upon the base cloth so as to achieve the preferred range of the clark stiffness.

The limit of the clark stiffness is associated with an angle between the orientation of a supply tray for feeding the cut-sheet form cloth printing medium and the printing direction. When the clark stiffness is too small, it becomes difficult to feed the cut-sheet form cloth printing medium to the pressure contact portion by the own weight of the cut-sheet form cloth printing medium and the driving force of the transporting drive roller. Conversely, when the clark stiffness is excessively large, difficulty is encountered to straighten the non-linearity, such as slight curl of the cut-sheet form cloth printing medium utilizing the peripheral surface of the transporting drive roller. Also, even when the cut-sheet form cloth printing medium is manually feeding to the pressure contact portion instead of using the feeding tray, it becomes necessary to hold the cut-sheet form cloth printing medium along the peripheral surface of the transporting roller. Therefore, the above-identified range of stiffness is preferred.

While the cut-sheet form cloth printing medium is employed in the shown embodiment, the printing medium may be in roll folded paper form, continuous paper form and so forth. In any case, appropriate measure may be taken for transportation, storage and so forth For instance, in case of the cut-sheet form cloth printing medium, it may be supplied into the market in a form packed into an aluminum deposited bag with a chuck and then stored in a box. Also, depending upon the application, it may be possible to supply such cut-sheet form cloth printing medium with a simplified package with a humidity-free paper.

Washing after ink-jet printing may be performed by water washing utilizing neutral detergent. However, in order to enhance dying ability, a fixing agent may be employed. The fixing agent may be provided in a form of tablet, sheet or so forth and may be soled in the same package with the cut-sheet form cloth printing medium. Furthermore, in order to further enhance dying ability, it is desirable to perform heat treatment by iron or so forth before performing washing.

Again, referring to FIG. 13, on the carriage 1706, four ink tanks 1701 storing respective of black, cyan, magenta and yellow inks and the integrated printed head cartridge 1702 integrating four printing heads 1174 for ejecting four color inks are mounted. In the shown embodiment, a tilted supply tray 1705 is provided for stabilizing automatic loading so that the tip end of the cut-sheet form cloth printing medium 1707 can be correctly placed in contact with the transporting drive roller 1703 by simply placing the cut-sheet form cloth printing medium 1707 along the supply tray. By rotatingly driving the transporting drive roller 1703 at this condition, the tip end of the cut-sheet form cloth printing medium 1707 can be correctly guided into the press contacting portion of the transporting roller pair. Thus, the cut-sheet form cloth printing medium 1707 can be automatically loaded into the transporting roller pair as the transporting means without causing oblique travel or puckering. In the shown embodiment, since the cut-sheet form cloth printing medium 1707 is cut along the texture as set forth above, stable textile printing with respect to the predetermined texture can be performed. Therefore, when the textile printed cloth is used for patch-work by cutting, it becomes possible to make the textile printed pattern and the texture consistent. Therefore, it becomes possible to create a product having no distortion. If the supply tray is not provided, by mating the tip end of the cut-sheet form cloth printing medium 1707 denotes aligned with the transporting drive roller and the transporting driven roller, the transporting drive roller is rotatingly driven for achieving loading of the cut-sheet form cloth printing medium 1707. Since the cut-sheet form cloth printing medium 1707 employed in the present invention has substantially equivalent transporting characteristics to the plain paper as set forth above, it can be applied for other known feeding registration adjusting mechanism.

The reference numeral 1703 denotes the transporting drive roller cooperated with the transporting driven roller 1704 for automatically loading the cut-sheet form cloth printing medium 1707 and rotating in the direction shown by arrow r with applying a constant tension to transport the cut-sheet form cloth printing medium 1707. While printing is not performed or when recovery operation of the ink-jet head is performed, the carriage 1706 is maintained at the home position (not shown) in stand-by state.

The carriage 1706 placed at the shown position (home position) before initiation of printing, is responsive to the print start command to move along a carriage guide shaft 1708. During travel, at a timing determined on the basis of a read signal of a linear encoder monitoring the position of the carriage 1706, four color inks are ejected through the ejection orifices on the printing head 1174 to perform printing on the printing medium in a width of d. By this printing scanning, black ink, cyan ink, magenta ink and yellow ink are ejected in order to form the dots. When printing of the data to the end of the printing medium is completed, the carriage returns to the home position and again perform printing for the next line. From completion of the first printing to initiation of the second printing, the printing medium is transported for the width d by rotation of the transporting drive roller 1703. At every scanning cycle of the carriage, printing and feeding of the printing medium in the magnitude of the width d are repeated to complete data printing for one printing medium. Upon completion of all printing operation, discharging of the printing medium by the transporting means is performed. In conjunction therewith, a platen 1709 which forms flat printing plane during printing is titled in the discharge direction for assisting discharging of the lower end portion of the printing medium. For assisting discharging of the printing medium and stably holding the printing portion of the cut-sheet form cloth printing medium 1707, a spur roller or other means may be provided at downstream of the printing portion.

In these construction, in addition to the cloth printing mode, consideration is given simultaneously with operability of the cloth to be printed, printing on the cloth can be easily performed.

Embodiment 10

In this embodiment, adjustment of the stiffness for the cloth for improving transporting ability is done by treatment with a stiffening agent for the cloth per se instead of adhering on the lower paper to obtain cut-sheet form cloth printing medium The targeted clark stiffness is greater than or equal to 10 and smaller than or equal to 400, preferable greater than or equal to 20 and smaller than or equal to 300, appropriate for automatic loading for the ink-jet printing apparatus, similarly to the foregoing embodiment 9.

In order to improve stiffness of the cloth per se, a treatment liquid (R) containing sizing compound shown in the following table is employed. As a concrete processing method, the cloth which is the cotton cloth in the shown embodiment, is once dipped in the treatment liquid (R). Subsequently, under a condition loaded a constant load, the cloth is squeezed between two rotating rollers to remove extra amount of the treatment liquid. Subsequently, by drying at 100° C. for 2 minutes, the cloth having a given stiffness can be obtained. Obtained treated cloth has a clark stiffness of 70. Then, when the obtained cloth is applied for the ink-jet printing apparatus to perform transporting test, good transporting ability can be obtained. Thereafter, employing the generally employed as shown in the first embodiment, printing was performed. By this, fine and precise image could be obtained.

| Treatment Liquid (R) | |
|---|---|
| sodium alginate | 5% |
| water | 95% |

Subsequently, in order to remove sizing agent from the printed cloth, washing is performed. At this time, in order to fix the dye of the printed image in the cloth, over the image on the cloth, a treatment liquid (S) having the following composition is applied for the overall surface by a doctor blade. Subsequently, drying was performed at a temperature 50° C. for 30 minutes. It should be noted that while the treatment liquid (S) is in a condition of solution, it has relatively high viscosity so as not to flow out the dye forming the image upon application of the treatment liquid (S).

| Treatment Liquid (S) | |
|---|---|
| polyallylamine hydrochloride | 30% |
| water | 70% |

Subsequently, washing by means of a home use washing machine with a warmed water at approximately 40° C., drying and iron finishing, the printing product having an original cotton feeling could be obtained.

In this construction, in comparison with the foregoing tenth embodiment, since no different member is fitted on the cloth, ease of printing can be improved.

Embodiment 11

Figure 16:
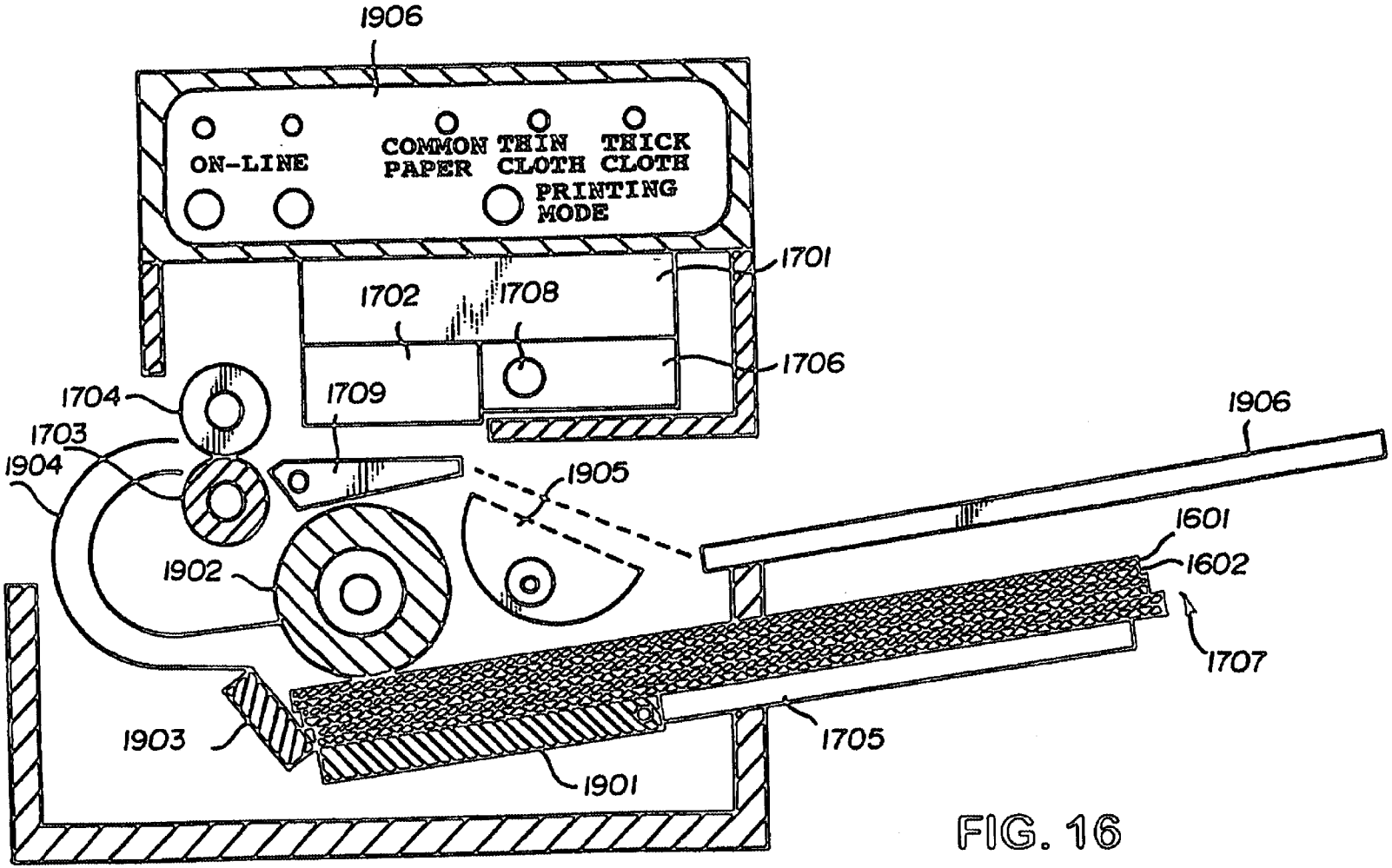
FIG. 16 is a diagrammatic sectional side view showing the printing portion in the ink-jet printing system capable of automatic setting and automatic feeding of the printing medium, to which the present invention is applicable.

In this embodiment, there is shown the embodiment of the ink-jet printing apparatus which has an automatic supply mechanism in addition to automatic loading of the cut-sheet form cloth printing medium as shown in FIG. 16. Also, in the shown embodiment, there is provided a mechanism for performing heat treatment to improve dying rate, after ink-jet printing. Furthermore, by improving the printing system in the ink-jet printing portion, a printing mode adapted for thick cut-sheet cloth is provided. Also, in order to select the printing modes, an operation panel 1910 is provided.

The supply system in the shown embodiment can supply the cut-sheet form cloth printing medium illustrated with respect to the ninth and tenth embodiments. As set forth above, cut-sheet form cloth printing medium is prepared for dying control of the ink, it is not desirable in view point of transporting ability and printing characteristics to drive the supply member at the side of the printing surface similarly to the transporting mechanism. Namely, the supply drive member as the driving side of the supply member typically employed in the ink-jet printing apparatus, is an elastic member such as rubber member. When the rubber member and the printing surface of the prepared cut-sheet form cloth printing medium are fictionally slide, the ink receptacle characteristics at the sliding portion can be varied to cause supply trace. On the other hand, when a little amount of preparation agent is transferred to the rubber member, it is possible to cause transportation failure by lowering of friction coefficient. Therefore, in the shown embodiment, the position of the supply drive member is limited to the back side (non-printing surface) of the cut-sheet form cloth printing medium. The cut-sheet form cloth printing medium shown in the tenth embodiment makes improvement for the transporting ability without employing the lower paper. Therefore, the preparation agent is present even on the back side. Therefore, in order to protect the supply drive member, the back side of the cut-sheet form cloth printing medium may be treated for preventing the preparation agent from being transferred to the supply drive member. Alternatively, without using special treatment agent, by performing sliding rubbing process for the back side in the roll condition before cutting, the preparation agent which can be transferred, can be removed.

The supply mechanism, in the shown embodiment, comprises a supply drive rubber roller 1902 which is driven to rotate depending upon necessity, a supply holding plate 1901 stacking the cut-sheet form cloth printing media and moving vertically depending upon necessity, a separating pad 1903 contacting with the tip end of the cut-sheet form cloth printing medium for separating the stacked cut-sheet form cloth printing media, and a supply guide 1904 feeding the separated cut-sheet form cloth printing medium to the transporting roller pair.

In response to a supply signal, the supply holding plate 1901 is elevated up so that the cut-sheet form cloth printing media stacked on the supply holding plate in back side up fashion and the supply drive rubber roller 1902 are pressure fitted by a depression force by a spring member provided in the supply holding plate. When the supply drive rubber roller is driven to rotate in the supply direction at this condition, the cut-sheet form cloth printing medium are driven to be fed by frictional sliding. At this time, since frictional sliding force is also generated between the stacked cut-sheet form cloth printing media, the uppermost cut-sheet form cloth printing medium contacting with the supply drive rubber roller is drawn. At the same time, the lower cut-sheet form cloth printing medium is also drawn to be fed. Then, a plurality of cut-sheet form cloth printing media transported in stacked fashion reaches the separating pad 1903. In the separating pad 1903, lowermost cut-sheet form cloth printing medium in the transported stack of the cut-sheet form cloth printing media is fictionally stopped, in order so that only one cut-sheet form cloth printing medium may pass the separation pad to be supplied. The cut-sheet form cloth printing medium thus separated and supplied reaches the pressure contact portion of the transporting roller pair rotatingly driven via the supply guide by the supply drive roller 1902 which continues rotation. Then, the cut-sheet form cloth printing medium is automatically loaded by the transporting rollers. At the timing where the cut-sheet form cloth printing medium is automatically loaded, the supply holding plate 1901 is lowered. Then, the supply force of the supply drive roller 1902 cannot be transmitted to the stack of the cut-sheet form cloth printing medium. At this timing, rotation of the supply drive roller is terminated to stop supply operation. In the shown embodiment, at the portion of the supply guide, the cut-sheet form cloth printing medium is reversed to be upside down. Therefore, while the cut-sheet form cloth printing medium is placed in directing the back side surface upwardly in the supply portion, the printing surface of the cut-sheet form cloth printing medium is directed upward when it passes through the transporting roller pair. Accordingly, the ink ejecting direction at the ink-jet printing portion is downward. The ink ejecting direction is slightly different depending upon the ink-jet printing system. However, it is preferred that the ink ejecting direction is in a range between downward direction and lateral direction. Then, the supply guide feeds the cut-sheet form cloth printing medium in the directed adapted to the ink ejecting direction. Also, by employing the mechanism similar to a both side printing unit in the modern copying machine, it may be possible to reverse the cut-sheet form cloth printing medium transporting by applying driving force to the back side, in upside down fashion.

In any case, the important construction for separating supply the cut-sheet form cloth printing medium in the shown embodiment of the supply mechanism in the shown embodiment, supply drive is limited to the back side of the cut-sheet form cloth printing medium. Accordingly, known system other than separation pad system, such as claw separation system can be employed. In such case, the supply drive member is pressed into contact onto the back side of the printing surface. In the automatic supply mechanism certain frictional sliding force is exerted on the cut-sheet form cloth printing medium as set forth above, the clark stiffness of the cut-sheet form cloth printing medium has to be set slightly higher. The supply characteristics becomes stable in the range of clark stiffness greater than or equal to 25 and smaller than or equal to 300.

The ink-jet printing operation per se is substantially the same as the construction in the embodiment of FIG. 13. Therefore, detailed discussion for the construction and operation is not neglected. In the shown embodiment, the heating means is provided at downstream of the ink-jet printing portion to perform heating process for the cut-sheet form cloth printing media depending upon necessity. As the heating means, conventionally known heating mechanism in the field of the printer, copying machine and so forth is applicable. It is only required to provide sufficient improvement of the dying rate targeted in the shown embodiment. Also, it is desirable to provide construction which permits appropriately adjusting and selecting heating condition depending upon the construction of the cut-sheet form cloth printing medium and material and thickness of the cloth. In the shown embodiment, an infrared heater with a reflector is employed as a primary heating means. Power supply for the infrared heater is controlled according to a predetermined heating condition in synchronism with the foregoing transporting operation of the cut-sheet form cloth printing medium associated with the ink-jet printing. When heating is performed directly on the printing surface side, it is possible to cause unevenness of heating or ink evaporation depending upon color distribution in the printing pattern. Therefore, in the shown embodiment, heating is performed from the back side. However, depending upon the construction of the heating means, heating condition and so forth, it is possible to perform heating directly on the printing surface or on the both surfaces. Also, it is possible to perform heating by contact heating system employing a heating plate or so forth. In the shown embodiment, as an auxiliary construction for the infrared heating system, a blower means (not shown) is provided for preventing heat or vapor from residing in the vicinity of the heating portion and whereby permitting stable heat control to generate a flow of air in the heating portion as required. Also, in the shown embodiment, since infrared heating is performed from the back side of the cut-sheet form cloth printing medium, in the case of the cut-sheet form cloth printing medium having the lower paper as in the ninth embodiment, it may be possible to improve infrared light absorption efficiency of the lower paper as the heat receptacle surface by employing a black color paper or so forth. Also, it is possible to improve heat transmission ability by adding an additive for the lower paper or the adhesive layer. Furthermore, it is possible to thinner lower paper in view of transportation and supply ability.

In the shown embodiment of the ink-jet printing apparatus capable of transporting the cut-sheet form cloth printing medium, adjustment and selection of the ink ejection amount depending upon the thickness and material of the cloth is permitted. When printing is performed employing the plain paper, the maximum ejection amount of the ink is limited in view of prevention of lowering of resolution, bleeding of the extra amount of ink, strike through and expansion of the fixing period. Typically, the maximum ink ejection amount is designed in a range of approximately 16 to 28 nl/mm$^2$, in case of the water type ink. However, when printing (textile printing) is to be performed for the cut-sheet form cloth printing medium as in the present invention, greater amount of ink can be received though the absorption amount of ink depends on the material, thickness, condition of preparatory treatment and so forth. Therefore, the present invention permits increasing of the ink ejection amount by performing high density printing at a lower printing speed that corresponding to a printing frequency, e.g. performing double density printing at one half of the printing speed, by performing overlapping printing by a plurality of cycles of printing scanning for the same printing region, by ink-jet head drive control for increasing the ink ejection amount, e.g. rising warming temperature of the ink-jet head utilizing the thermal energy or by performing multi-pass printing. In the shown embodiment, when thick cloth printing mode is selected as the printing mode through the operation panel 906, 300% printing is performed for all colors by overlapping printing for the same printing region for three times. On the other hand, when thin cloth printing mode is selected, 200% printing is performed for all colors. When a plain paper printing is designated, 100% printing is performed. Therefore, depending upon the cloth to be printed, optimum printing condition can be selected so as to permit sufficient dying within the yarn. Thus, deeper color textile printing cloth can be obtained. Since the textile printing is performed on the cut-sheet form cloth printing medium employing the ink-jet printing apparatus having the supply mechanism, heating mechanism and the ink ejection amount increasing mechanism, simple ink-jet textile printing can be performed with enhanced operation ability, dying ability and color depth.

Embodiment 12

Figure 17:
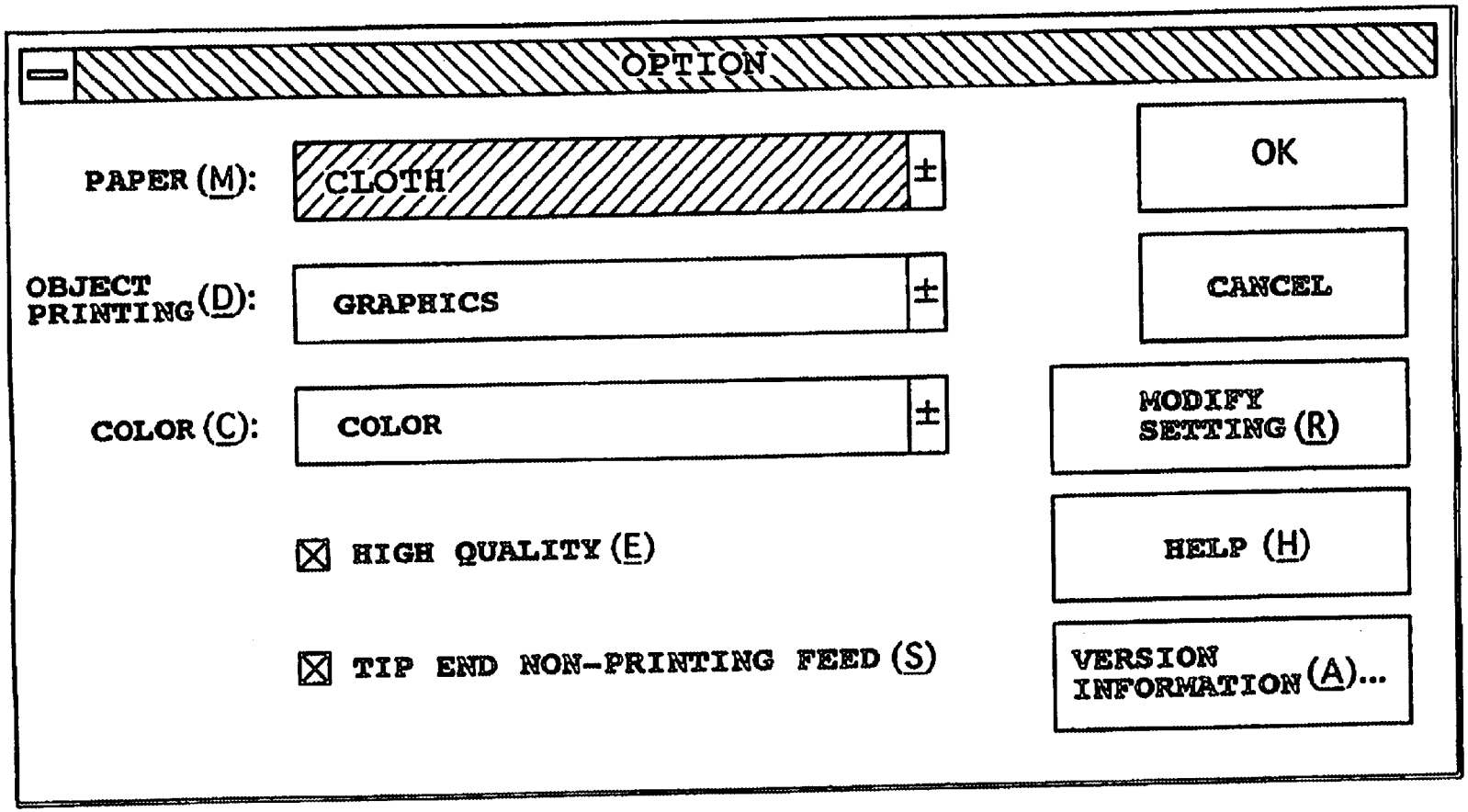
FIG. 17 is a diagrammatic illustration showing one example of display for selecting a cloth printing mode on a host computer.

This embodiment shows the case where the cloth printing mode is set on a display screen of the host computer by a printer driver as illustrated in FIG. 17 By selecting the cloth printing mode, an identification signal is fed from the host computer to the ink-jet printing apparatus. The operational mode of the ink-jet printing apparatus is automatically switched into the designated printing mode within the ink-jet printing apparatus. Here, when "cloth" is selected as a paper to be printed, the printing mode as discussed with respect to the second embodiment is automatically set. Furthermore, in the printing portion, a distance between a plane where the ejection orifice of the ink-jet head are arranged and the surface of the printing medium (hereinafter referred to as "head-paper distance") simultaneously expanded for 0.5 mm. Here, discussion will be given for expansion of the head-paper distance from the normal distance for printing on other printing medium. Namely, as set forth above, the cloth has greater ink receptacle capacity. However, in addition, the cloth, particularly, natural fiber cloth, differentiates hydrosopics depending upon the humidity in the environmental air. Accordingly, when printing is performed in the printing mode set herein, if the environmental humidity is high and the proportion of black in the image is large, the water content in the close at the printed portion becomes substantially high. As a result, volume expansion of the cloth per se may be caused to result in disturbance of the flatness of the surface to be printed and to further result in cockling of the cloth per se. When cockling is caused in the cloth, since non-printing surface, namely since the back side of the cloth is supported by the platen, the cloth tends to project toward the ink-jet head. If the projecting magnitude is significant, the ink-jet head and the cloth may collide during scanning of the ink-jet head to possibly cause damaging of the ink-jet head. In order to avoid this, when the cloth printing mode is set, it becomes necessary to preliminarily set the head-paper distance greater. However, when the head-paper distance is set greater, it may results in degradation of precision in the dot forming position. However, as set forth above, in case of the cloth printing, since the dot diameter is large in nature and not so high precision in the dot forming position is required in view of feeling of the cloth print, expansion of the head-paper distance will not create any practical problem. It should be noted that modification of the head-paper distance may be done by providing a mechanical construction on the carriage for manually or automatically adjusting the head-paper distance.

In the construction set forth above, with respect to the ink-jet printing apparatus pre se, substantially no attention should be paid except for loading of the cloth, and instead, optimal setting can be done automatically for the printer on the host computer. Therefore, the shown embodiment is advantageous in the point where the user may not require substantial attention at various conditions.

Embodiment 13

Figure 18:
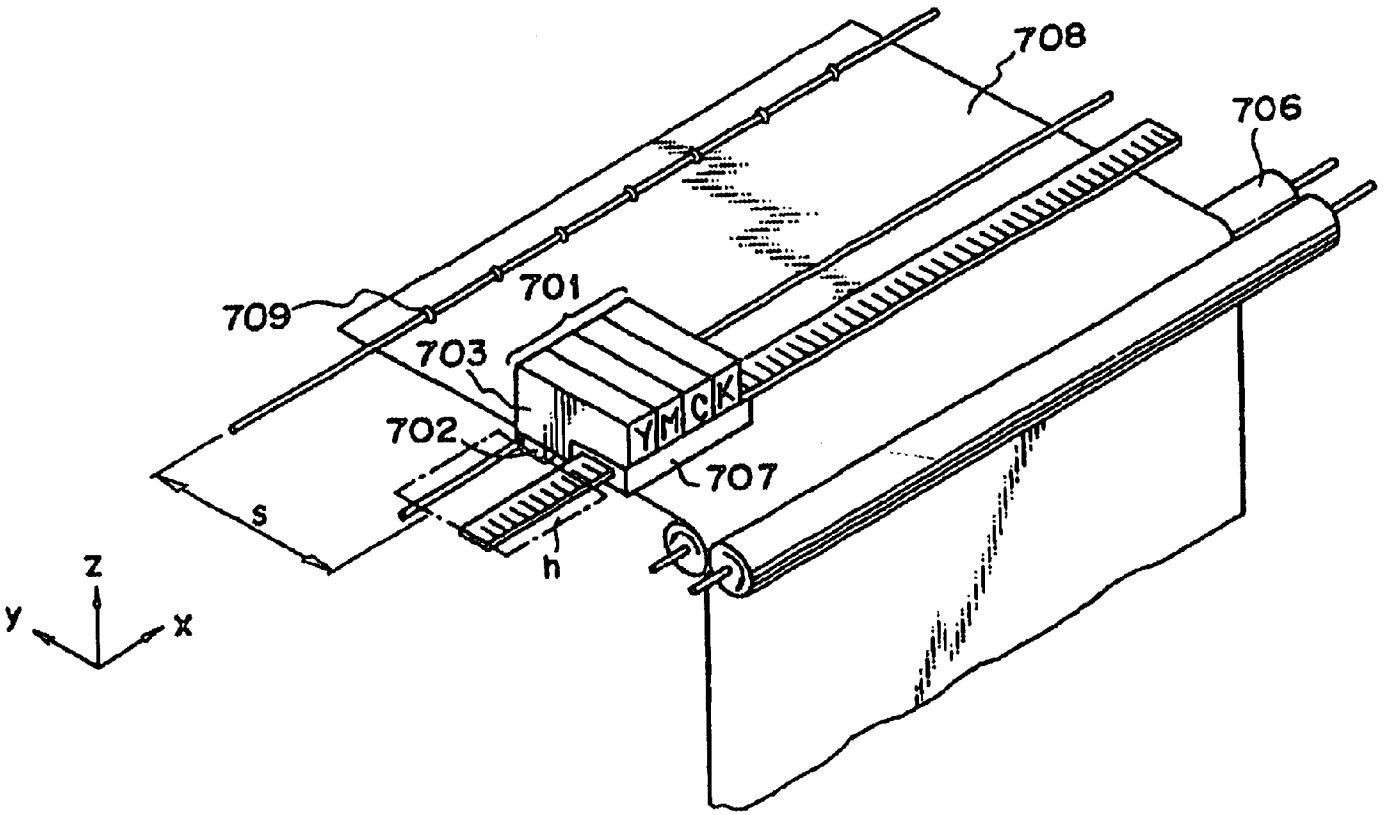
FIG. 18 is an explanatory illustration showing a manner of non-printing feed of the printing medium in the cloth printing mode in one embodiment of the present invention.

FIG. 18 shows an embodiment of the ink-jet printing apparatus, in which, within the ink-jet textile printing apparatus, and after completion of printing of the image on the cloth, a spur roller 709 is provided in the ink-jet printing apparatus for restricting vertical motion of the, cloth printing medium at the discharge outlet when the printed cloth printing medium is discharged from the ink-jet textile printing apparatus. This super roller 709 is normally provided for avoiding the printing medium to move vertically and whereby avoid collision of the cloth to the ink-jet head portion. Therefore, significant force is not necessary. Also, it is unnecessary to fix the cut-sheet form cloth printing medium in overall surface to perform the required effect. Therefore, the spurs are provided at a given interval to contact with the printing medium in point contact. With such construction, in the general purpose printing apparatus applicable for variety of printing media, stable medium transportation can be realized with simple construction.

When such printing apparatus is applied for printing on the cloth, and when printing operation is initiated after setting the cloth printing mode as set forth above, the tip end of the printing medium is fed without printing for a predetermined magnitude to pass the overall region of the tip end portion through the contacting portion of the spurs. Thereafter, ejection of ink from the ink-jet head is initiated. Here, shifting magnitude of the tip end of the printing medium, namely distance s in FIG. 18 is determined depending upon the printing apparatus to be used. However, typically, since the spurs are effective as arranged at positions near the ejecting portion of the printing head, the distance s is approximately 20 to 50 mm. In the shown embodiment, the distance s is set at 40 mm. This operation has not be required in printing on the conventional plain paper or OHP film, but is quite effective for the cloth for assuring stable transportation since the cloth has high hydroscopic characteristics and weak in bending. However, when the cloth is in a form of cut-sheet, it becomes necessary to cut to form the cut-sheet with an extra length for such non-printing feeding of the tip end. In this case, since the cloth will subject sewing after printing in most case, the cut-sheet is not required to be the precisely in fixed dimension. Therefore, providing the extra length for non-printing feeding will not cause substantial problem.

Embodiment 14

Figure 19:
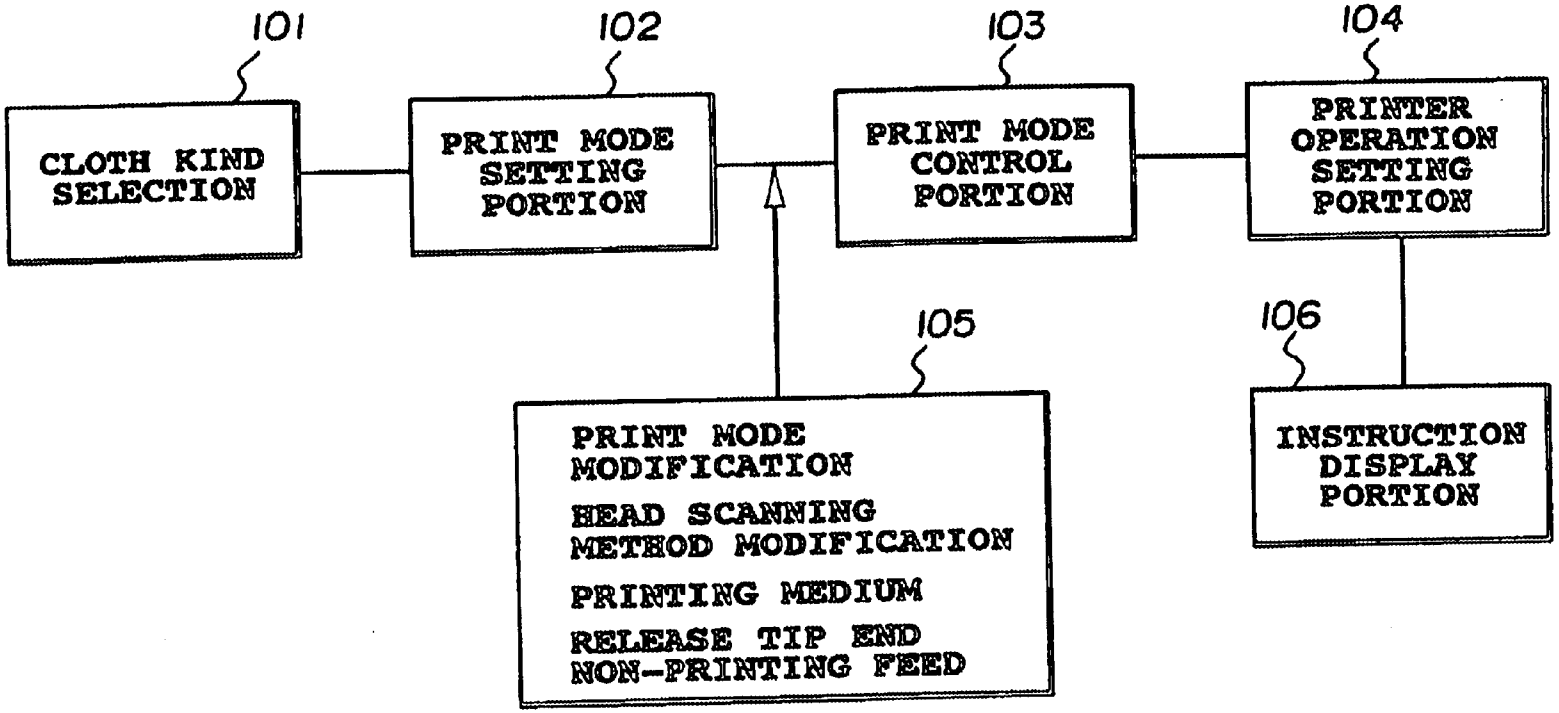
FIG. 19 is an explanatory illustration showing a manner of setting of various printing mode in one embodiment of the ink-jet printing system according to the present invention.
Figure 20:
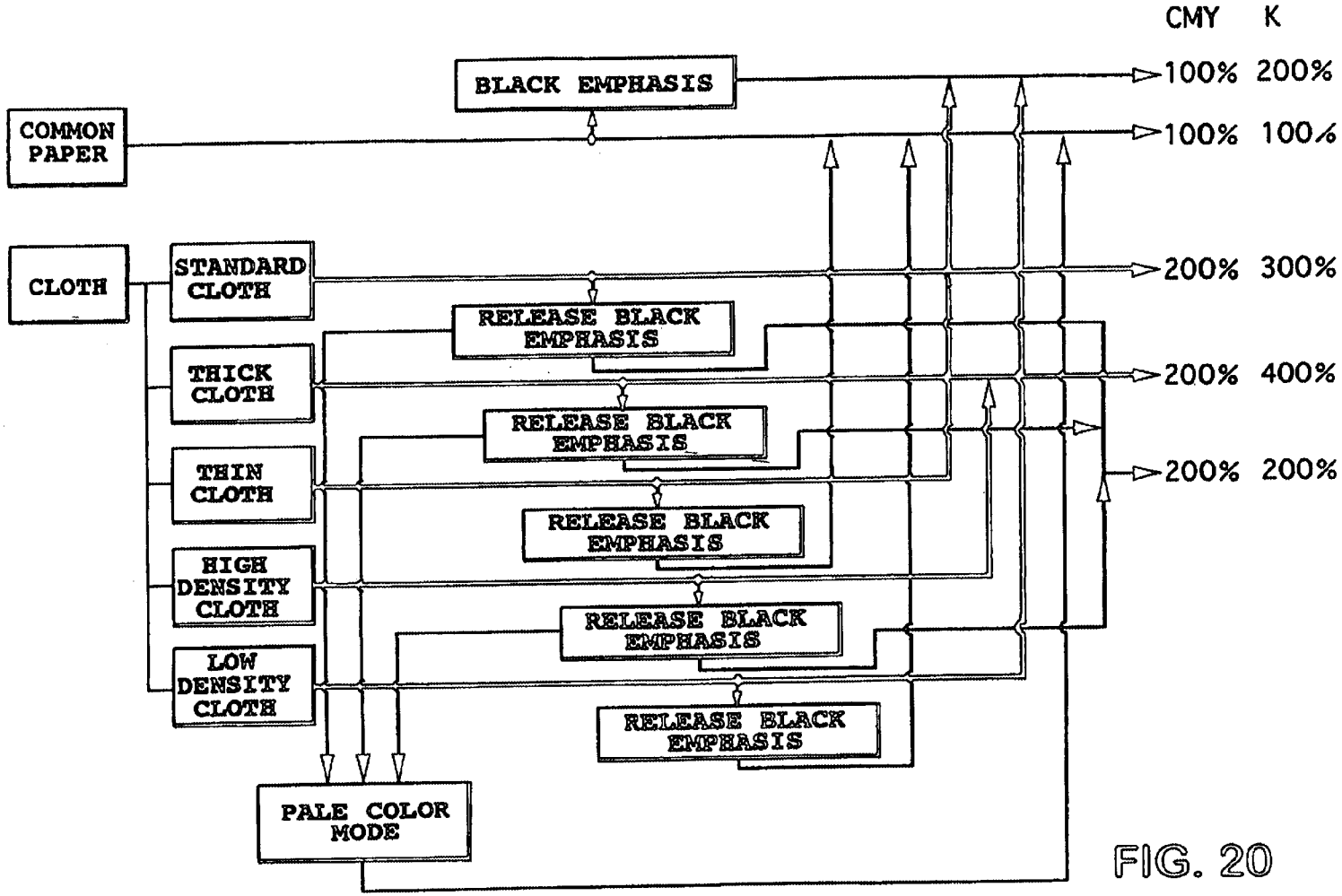
FIG. 20 is an explanatory illustration showing a flow of process in various printing modes shown in FIG. 19.
Figure 21C:
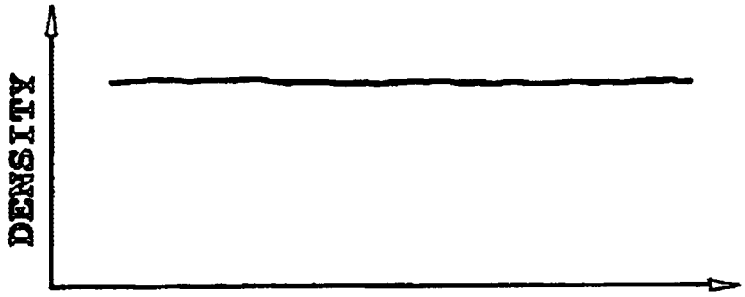
FIGS. 21A, 21B and 21C are explanatory illustration showing ideal form in the ink-jet printing.
Figure 21B:
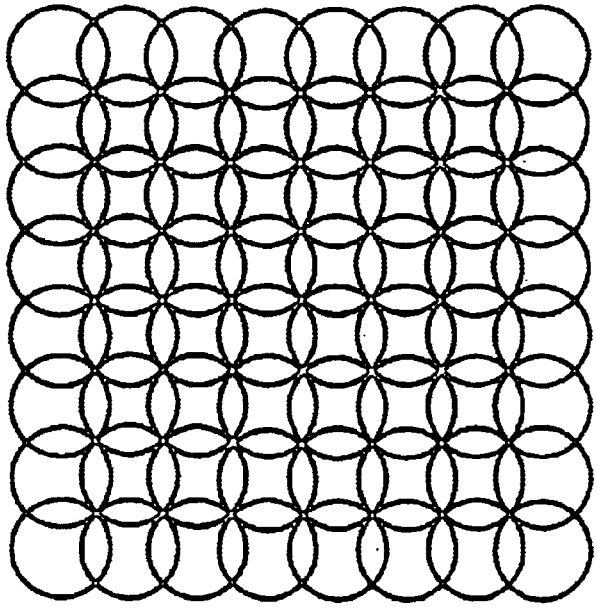
Figure 21A:
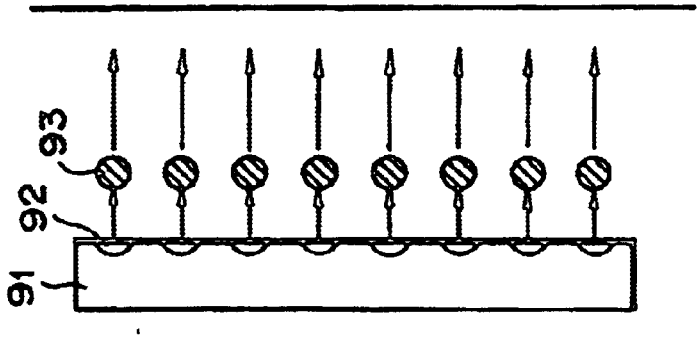
Figures 23A, 23B, 23C:
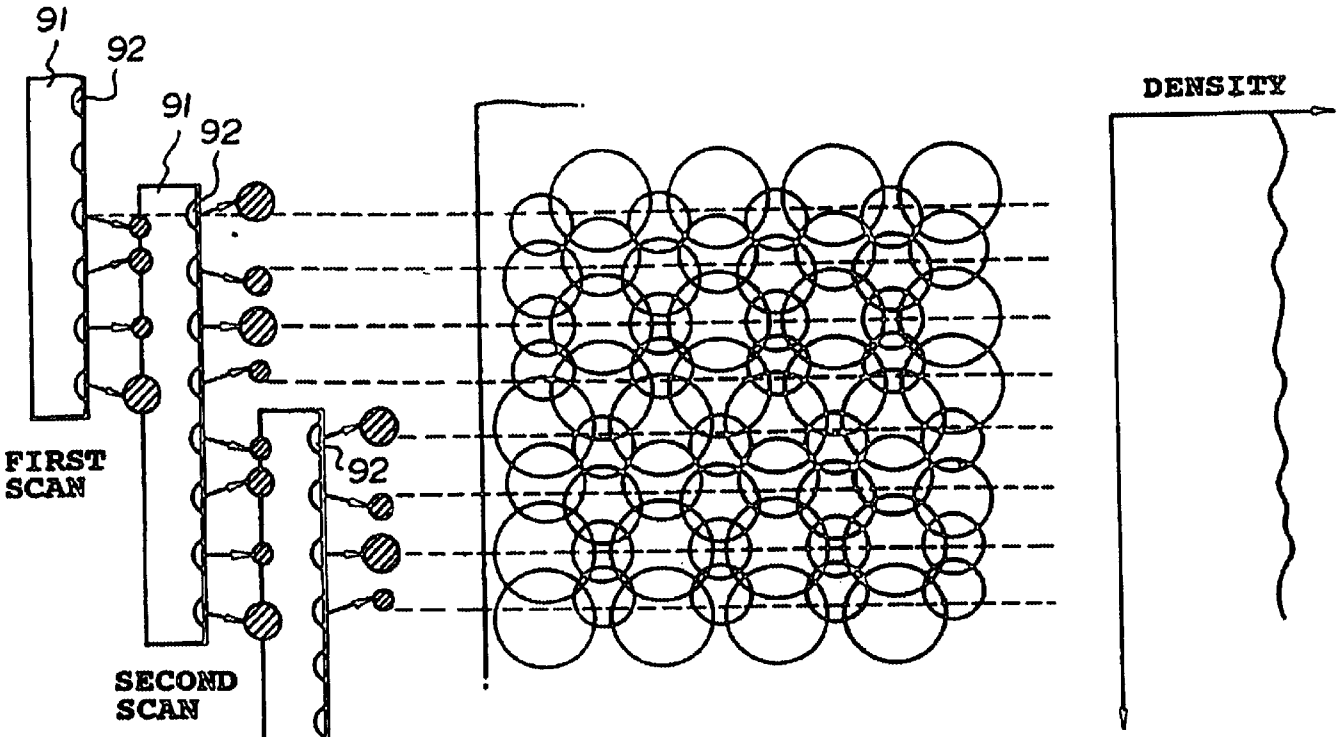
FIGS. 23A, 23B and 23C are explanatory illustration showing a divided printing method in the ink-jet printing.
Figure 24A:
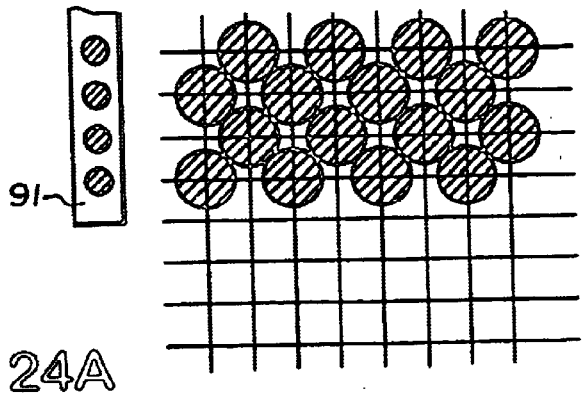
FIGS. 24A, 24B and 24C are explanatory illustration showing a printing steps in divided printing method in the ink-jet printing.
Figure 24B:
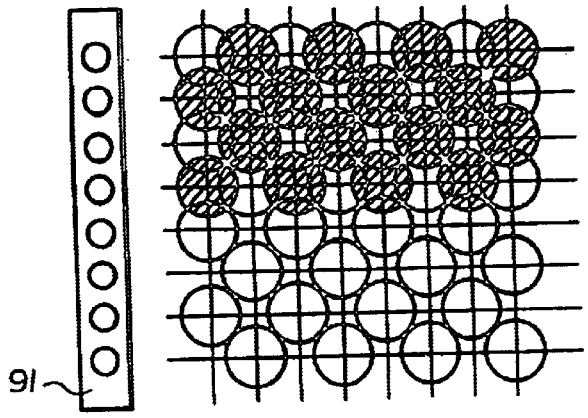
Figure 24C:
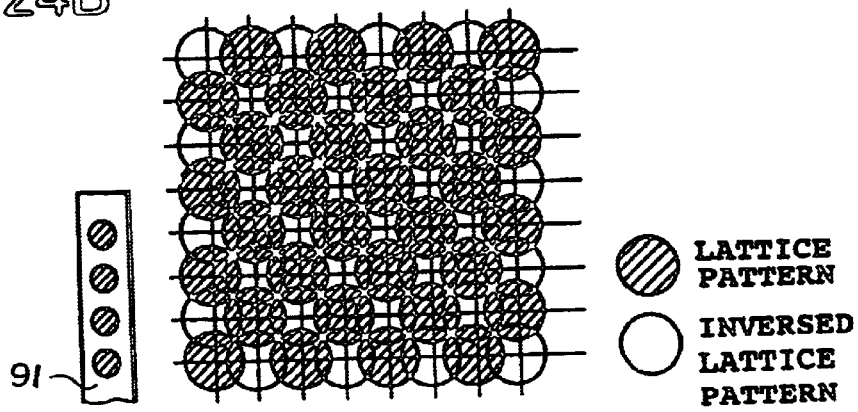

FIGS. 19 and 20 show a flow of setting process in the system where various setting depending upon the cloth to be used and the desired image quality in the printing mode in the ink-jet textile printing apparatus for performing printing on various kinds of clothes. Upon making various setting, as set forth with respect to the twelfth embodiment, setting can be performed by the host computer via the printer driver. In addition, it is also possible to make setting by a switch, such as a panel on the ink-jet textile printing apparatus as set forth with respect to the eleventh embodiment.

At first, the desired image is prepared on the host computer. Then, the printing signal of the prepared image is fed from the host computer to the ink-jet textile printing apparatus. At this time, similarly to the twelfth embodiment, the printing mode setting is displayed as shown in FIG. 17. The column which is normally set as "paper", namely the column of identification of the printing medium is set as "cloth". Then, the operation is shifted to setting of the operation mode for cloth printing as shown in FIG. 19. When the operational mode is shifted, more precise setting different from that for conventional printing mode for paper or so forth, becomes possible. Thus, appropriate printing can be arbitrary performed depending upon the cloth to be used and the image to be printed. Hereinafter, the flow will be discussed with reference to FIG. 19 and to FIG. 20 as required.

After shifting into the operational mode setting for the cloth printing, at first, with respect to the kind of cloth to be used. In the flow from "cloth kind selection 101" to "printing mode setting portion 102" selection and setting of the printing mode is performed. Here, on the basis of the information stored in ROM or non-volatile memory or so forth, printing mode is determined. On the basis of the printing mode thus determined, the ink ejection amount depending upon the kind of the selected cloth is determined in straightforward manner. In conjunction therewith, the ink-jet head scanning method and the non-printing feeding magnitude of the printing medium are also determined. Among these setting, the kind of cloth may be selected among a standard cloth, thick cloth, thin cloth, high density cloth, low density cloth as shown in FIG. 20, in the shown embodiment. The factors for determining the printing mode are the size of the fiber, density of the aggregate of the fiber. Therefore, whether stiffening is performed or not will not influence directly. Accordingly, upon selection, stiffening condition is not included in the items of selection. Also, the predetermined values of the printing mode are all determined employing the setting emphasizing black for high quality image.

Next, at the various printing mode thus set, the operation is shifted to the printing mode control portion 103, in which the printing mode is included in the image signal. Within this path, a printing mode modifying portion 105 is provided so that the printing mode may be arbitrary modified as required. Here, with respect to the predetermined value of the printing mode set out with respect to the printing mode setting portion, the printing mode modifying portion 105 is designed for permitting arbitrary modification of the ink ejection amount for each color, ink-jet head scanning method, non-printing feeding magnitude of the printing medium. Discussion will be given concerning modification of the ink ejection amount with reference to FIG. 20. For each kind of cloth, releasing of the black emphasizing, reduction of the ink ejection amount for all colors for pale color mode are provided. The output image can be modified in various form as desired by the user. For instance, in case of standard cloth, the normal ink ejection amount is 200% for cyan, magenta and yellow and 300% for black. However, when emphasizing of black is released, the ink ejection amount is modified to 200% for cyan, magenta and yellow and 200% for black. Furthermore, when the pale color mode is selected, the ink ejection amount may be modified to be 100% for cyan, magenta and yellow and 100% for black.

By taking the control process set forth above, even though variety of setting for the printing mode is provided, the determined printing mode may be classified as several groups. Also, it becomes possible to make the setting common with the conventional printing mode for paper or so forth. Therefore, even when wide variety of setting is permitted for the user, no problem of increasing of the size of the apparatus, significant increasing of the cost will never been caused. In FIG. 20, with respect to thin cloth and low density cloth, shifting to the pale mode is not illustrated. This is because that, in these modes, when black emphasizing mode is released, ink ejection amount for all colors are set at 100%, and the ink ejection amount can be set smaller than 100%. When the ink ejection amount is reduced to be lower than 100%, dots for forming of the image may be partially dropped out to cause a problem in establishing of the image.

Through the process set forth above, when the desired image is to be printed on the cloth to be used, after determining the printing mode, the image signal containing various setting information is transferred to a printer operation setting portion 104. Here, in concrete, control signals for accumulating the image signal in a buffer and feeding signals for ink ejection amount, scanning method, the tip end non-printing feeding magnitude to a printing control circuit. Through these processes, actual operation of the printing portion is initiated. At this time, as set forth above, the cloth is easily influenced by cockling, the head-paper distance has to be set wicker. For notifying instruction or actual operation mode to be user together with printing operation, an instruction display portion 106 is provided. It should be appreciated that such information can be displayed either or both of the display of the host computer and the panel provided in the printing apparatus.

In the discussion given above, manner of making various modification, such as modification of the printing mode will be discussion in concrete manner with an example. At first, discussion will be given for modification of the printing mode. This function is provided since the value set as the predetermined value is set for most typical material among all clothes and such value can be not appropriate when the material of the cloth is varied. Also even when the material is not varied, it is possible that modification of the initial setting is preferred depending upon the content of the image to be printed. In such case, with respect to the predetermined value, the ink ejection amount can be intentionally modified, i.e. reduced. When the modification from the predetermined value is desired, "modification of setting" in FIG. 17 is selected, for example. Subsequently, with respect to the currently selected paper (here cloth), a list of kinds which can be modified is displayed to permit modification. For instance, when the image is desired to be printed with uniform tone in overall image, it becomes unnecessary to increase the ejection amount for black for emphasizing. Therefore, in such case, the emphasizing of black nay be released. Also, in the case where the cloth stiffened by adhering the lower paper on the back side is used, since stability against cockling is relatively high, it may be possible to release non-printing feeding at the tip end. As set forth, while appropriate printing mode is set for each kind of cloth, setting can be easily modified as desired by the user.

It should be noted that, Concerning releasing of non-printing feeding, this mode can be selected when the length of the cloth is not long enough or the image is desired to be printed over overall surface of the cut-sheet form cloth. The printing mode, in which the non-printing tip end feeding mode is performed, can be selected only when no problem pointed out with respect to the thirteenth embodiment will be arisen.

It should be appreciated that while the foregoing embodiments have been discussed in terms of the method to perform control for number of ink droplets to be ejected for one pixel by multi-pass printing at respective printing modes, the manner of adjusting the ink ejection amount for one pixel is not specified to the foregoing method. Namely, even when the ink droplet to be ejected is one, the object of the invention can be achieved by appropriately adjusting the amount of ink in the ink droplet. In typical ink-jet system, the ink ejection amount becomes greater as rising of the own temperature of the ink-jet head per se. Accordingly, even in the present invention, when the cloth printing mode is set, the printed cloth with increased printing density can be attained through a printing sequence and with throughput completely the same as other printing modes by setting the printing mode to perform printing at the elevated temperature of the ink-jet head. However, in practice, the ejection capacity of the ink-jet head is limited. Therefore, it is difficult to eject the ink in the amount corresponding to two ink droplets. Therefore, this method may be effectively applicable in the case where an appropriate value falls within 100% to 200%.

By taking this method, fine adjustment for less than or equal to one dot. Accordingly, by combining the method of the shown embodiment with the foregoing embodiments, printing can be performed at the optimal ink ejection amount even for the cloth printing medium requiring ink ejection amount greater than or equal to 200%. Also, the shown method is effective not only for increasing the ejection amount for all colors but also for the case where only one color (typically black) is particularly emphasized. In this case, by adjusting the black ejecting head at the elevated temperature higher than the printing heads for other colors. This method is thus effective for the case where one color is emphasized, such as the black emphasis. In this case, by adjusting the temperature of the ink-jet head for black ink at higher temperature, appropriate correction of the ejection amount can be done. Normally, the method to eject large amount of ink at one time may cause lowering of fixing ability of the ink to the cloth and thus cause bleeding at the boundary of different colors to degrade the image quality. However, by performing printing with the ink having high penetration ability, which is employed in the present invention, such degradation of the image may not be caused.

With the construction set forth above, by one ink-jet textile printing apparatus, new printing medium, such as cloth, can be added in addition to the conventional media, such as paper. In addition, with respect to printing on the cloth, setting of the printing system can be arbitrary modified depending on the user's taste. Therefore, higher level and more complicate color expression can be done.

Embodiment 15

FIG. 25 is a table showing a list of variety of printing modes provided in the ink-jet printing apparatus, classified depending upon the printing medium. In the table, in addition to the ink ejection amount set out in the foregoing embodiment, printing method, namely scanning method of the ink-jet head is also shown. Here, K, C, M, Y are abbreviations of ink colors similar to those noted in the first embodiment.

As can be clear from the shown table, in the plain paper which is most frequently used in the ink-jet printing apparatus, the ink ejection amount is set at 100% for all colors and printing is performed by reciprocative scanning (two passes) with 50% mask. When high quality image printing, namely black emphasizing printing is desired, printing scanning is performed for another reciprocating scanning cycle. Accordingly, the ink ejection amount becomes 200% in two reciprocating scannings. However, since the ink ejection amount for the colors other than black has to be maintained at 100% in the above two reciprocating scannings (four passes), the mask is changed to 25% mask.

In case of the OHP film, for the usage to extend the image by projection, high precision of the image quality is required. Therefore, black emphasis is performed at standard. In addition, as a measure for fluctuation of the dot forming position, 25% mask is employed. Associating with this, number of scanning cycles is increased. On the other hand, in case of the coated paper, since the coated paper has high coloring ability by the ink, black emphasis is not always required. However, for higher capability of control of the spread of the dot upon ink ejection to make it uniform, than the plain paper, higher quality printing is performed in the manner similar to that of CMY for OHP film.

Similar consideration is applicable for the cloth. However, since greater ink ejection amount is required, number of scanning cycles of the ink-jet head has to be set four reciprocating cycles (eight passes). Also, in case of the cloth printing, since greater ink ejection amount is required in comparison with printing for other printing media, head accumulation rate of the head generated in the ink-jet head associating with the printing operation becomes higher. Accordingly, it is desirable to perform recovery operation at higher frequency than that conventionally done. In particular, in view of co-relation between the heat accumulation amount and the residual bubble, sucking recovery is effective. Also, it is effective to store integrated number of ejected dots and to set the timing to perform sucking recovery on the basis of the stored value.

As set forth, in the ink-jet printing apparatus, upon performing cloth printing, it is important feature to optimally switch the scanning method of the ink-jet head in addition to optimal setting of the ink ejection amount.

The printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods of machine stitch the textile to make clothes and other daily needs are disclosed widely in publicly known publications.

As described above, according to the present invention, it is possible to obtain a high cleaning effect of the liquid discharging surface of the liquid discharging head as well as a long-time stability of the liquid discharging.

Thus it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing, that is a bubble jet method proposed by CANON INC. This is because such a system can achieve a high density and high resolution.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker response. The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (lincar type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing widths the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording These systems are effective for reliable recording.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

Set forth above description, according to the present invention, there is provided a system in which switching means can properly select one printing mode among one or more kinds of cloth printing modes which differs in a printing condition from a printing mode corresponding to other printing medium, and various kinds of condition such as amount of ejected ink and method of ink ejection can be employed. As a result, a printed cloth with high surface density and high resolution can be freely obtained during short time not only by using an industrial ink jet textile printing apparatus but also by using an ink jet printing apparatus for personal use.

What is claimed is:

1. An ink-jet printing apparatus employing an ink-jet head and performing printing by ejecting an ink onto a printing medium from said ink-jet head while the ink-jet head and the printing medium are relatively moved, comprising:

setting means for setting a printing mode by selecting a particular printing mode from a set of printing modes including a cloth printing mode for performing printing on a cloth and a plurality of printing modes for performing printing on a plurality of kinds of printing media other than the cloth, respectively; and printing control means for performing printing operation for the printing medium corresponding to the printing mode set by said setting means, wherein in said cloth printing mode, an amount of ink to be ejected onto a unit area of said cloth is greater than the amount of ink to be ejected onto the unit area of the printing medium other than the cloth in any of said plurality of printing modes.

2. An ink-jet printing apparatus as claimed in claim 1, wherein said printing control means operates said ink-jet head to reciprocally scan on the printing medium so that the ink is ejected in both of forward and reverse scanning in said cloth printing mode and so that ink is ejected at either of forward and reverse scanning cycle.

3. An ink-jet printing apparatus as claimed in claim 2, wherein said printing control means performs printing by a plurality of reciprocating scanning cycles, in at respective of a plurality of reciprocating scanning cycles, printing is performed with a thinned pattern of the ejection data of the pixel to be printed, and said patterns for said plurality of reciprocating scanning cycles are differentiated from each other.

4. An ink-jet printing apparatus as claimed in claim 3, wherein in respective of reciprocating scanning cycles, the ink is ejected from ejection orifices of said ink-jet head corresponded by movement of said printing medium, said ejection orifices are differentiated at each scanning cyclc.

5. An ink-jet printing apparatus as claimed in claim 1, which is dedicated to personal use.

6. An ink-jet printing apparatus as claimed in claim 1, wherein said ink-jet head ejects ink by pressure of a bubble which is generated by giving thermal energy to an ink.

7. An ink-jet printing apparatus as claimed in claim 1, wherein said plurality of printing modes include a plurality of printing modes for performing printing on the cloth, and the amount of ink to be ejected to a unit area of the cloth in respective printing modes for performing printing on the cloth is different from each other.

8. An ink-jet printing apparatus as claimed in claim 1, wherein printing in said printing mode for performing printing on the cloth is performed in a manner that an amount of ink ejected by the ink-jet head is less than that in the printing mode for performing printing on a common paper while a single scanning operation of said ink-jet head to the printing medium is performed, and that a number of times of scanning operation of said ink-jet head over a predetermined region of the printing medium is greater than that in said printing mode for performing printing on the common paper.

9. An ink-jet printing apparatus employing an ink-jet head and performing printing corresponding to a set printing mode by ejecting an ink onto a printing medium from said ink-jet head while the ink-jet head and the printing medium are relatively moved, comprising:

a preferential mode for performing printing under conditions as taking a common paper as reference of the printing medium;

a cloth printing mode for performing printing on a cloth with setting a condition, in which at least one of said conditions in said preferential mode is set for higher image quality; and means for setting said preferential mode preferentially to said cloth printing mode, and for setting said cloth printing mode in place of said preferential mode when the cloth printing mode is selected, wherein in said cloth printing mode, an amount of ink to be ejected onto a unit area of said cloth is greater than the amount of ink to be ejected onto the unit area of the printing medium in said preferential mode, and said at least one of said condition is a condition related to respective amounts of black and color inks to be ejected to the unit of the printing medium.

10. An ink-jet printing apparatus as claimed in claim 9, wherein, in said cloth printing mode, the conditions in said preferential mode for performing printing by ejecting ink other than black is modified to the condition for higher image quality.

11. An ink-jet printing apparatus as claimed in claim 9, wherein, in said cloth printing mode, the conditions in said preferential mode for performing printing by ejecting black ink is modified to the condition for higher image quality.

12. An ink-jet printing apparatus as claimed in claim 11, wherein said printing mode is the mode determining number of scanning cycles of the ink-jet head, determining ejection portion to eject ink by AND of a print mask preliminarily set in binary value by dot matrix and an image data to be printed, and sequentially forming the image, and said cloth printing mode is the mode, in which proportion of dots to perform ink ejection or number of scanning cycle is increased in comparison with the proportion of the dots to perform ink ejection or number of scanning cycle in said preferential printing mode.

13. An ink-jet printing apparatus as claimed in claim 9, wherein said cloth is preliminary subject to a stiffening process to have clark stiffness greater than or equal to 10 and smaller than or equal to 400.

14. An ink-jet printing apparatus employing an ink-jet head and performing printing by ejecting an ink onto a printing medium from said ink-jet head while the ink-jet head and the printing medium are relatively moved, comprising:

reference cloth printing mode for performing printing on a cloth with taking a color ink printing condition for printing by ejecting different colors of inks, and a black ink printing condition for printing by ejecting black ink different from said different colors of inks as preferential condition; and selected cloth printing mode for performing printing under a condition, in which at least one of said color ink printing condition and said black ink printing condition is modified depending upon the kind of the cloth; and means for setting said selected cloth printed mode in place of said reference cloth printing mode when said selected cloth printing mode is selected, wherein said at least one of said color ink printing condition and said black ink printing condition is a condition related to respective amounts of black and color ink to be ejected to the unit of the printing medium.

15. An ink-jet printing system employing an ink-jet head and performing printing by ejecting an ink onto a printing medium from said ink-jet head while the ink-jet head and the printing medium are relatively moved, comprising:

at least one cloth printing preferential mode for performing printing on a cloth; and switching means for selecting said at least one cloth printing preferential mode;

wherein conditions of a printing mode for performing printing on other printing medium can be set by in differentiating at least one of the conditions in said cloth printing preferential printing mode a host computer which generates an image signal and said at least one of the conditions is a condition related to respectively amounts of black and color inks to be ejected to the unit of the printing medium.

16. An ink-jet printing system as claimed in claim 15, wherein said at least one cloth printing preferential mode for performing printing on the cloth and switching means for selecting said at least one cloth printing preferential mode can be set on the apparatus performing printing operation according to the image signal to be printed.

17. An ink-jet printing system as claimed in claim 13, which can eject a plurality of colors of inks and the ink ejection amount for the printing medium is increased for at least one of the colors among a plurality of inks.

18. An ink-jet printing system as claimed in claim 17, wherein, among inks to be ejected in the ink-jet printing system capable of ejecting a plurality of colors of inks, the ejection amount of the ink for black color printing is set to be greater than or equal to the ink ejection amount for other colors.

19. An ink-jet printing system as claimed in claim 18, in the cloth printing preferential mode, the printing is performed by thinning the image data to be printed according to predetermined image data array, performing ejection of ink by reciprocating move said ink-jet head along a primary scanning direction according to the thinned image data, and feeding said printing medium for a distance less than or equal to a length of said ejection orifices.

20. An ink-jet printing system as claimed in claim 15, wherein said cloth is preliminary subject to a stiffening process to have clark stiffness greater than or equal to 10 and smaller than or equal to 400.

21. An ink to be used in an ink-jet printing system employing an ink-jet head and performing printing by ejecting the ink onto a printing medium from the ink-jet head while the ink-jet head and the printing medium are relatively moved, the ink-jet printing system comprising at least one cloth printing preferential mode for performing printing on a cloth, and switching means for selecting said at least one cloth printing preferential mode, wherein conditions of a printing mode for performing printing on an other printing medium can be set by differentiating at least one of the conditions in the cloth printing preferential printing mode in a host computer which generates an image signal, and said at least one of the conditions is a condition related to respectively amounts of black and color inks to be ejected to the unit of the printing medium, the ink comprising of:

a water base ink containing a surface-active agent, the content of said surface-active agent being less than a critical micell concentration versus ink and being greater than a critical micell concentration versus water when said surface-active agent is added to a water.

22. An ink as claimed in claim 21, further comprising:

a reactive dye which serves as a coloring agent in said ink.

23. An ink-jet printing system comprising:

a plurality of ink tanks storing a plurality of inks, said inks being exchangeable according to the cloth which is used, said inks being used in an ink-jet printing system employing an ink-jet head and performing printing by ejecting the ink onto a printing medium from the ink-jet head while the ink-jet head and the printing medium are relatively moved, the ink-jet printing system comprising at least one cloth printing preferential mode for performing printing on a cloth, and switching means for selecting said at least one cloth printing preferential mode, wherein conditions of a printing mode for performing printing on an other printing medium can be set by differentiating at least one of the conditions in the cloth printing preferential printing mode in a host computer which generates an image signal, and said at least one of the conditions is a condition related to respectively amounts of black and color inks to be ejected to the unit of the printing medium, each said ink comprising;

a water base ink containing a surface-active agent, the content of said surface-active agent being less than a critical micell concentration versus ink and being greater than a critical micell concentration versus water when said surface-active agent is added to a water; and a reactive dye serving as a coloring agent in the ink.

24. A method for producing an ink-jet printed product, comprising the step of:

printing on the cloth by a one of direct printing and transferring an image to the cloth after the image has been printed once on a transfer medium by an ink-jet printing system, wherein the ink jet printing system employs an ink-jet head and performs printing by ejecting an ink onto the transfer medium from the ink-jet head while the ink-jet head and the transfer medium are relatively moved, the ink jet printing system having at least one cloth printing preferential mode for performing printing on a cloth and switching means for selecting the cloth printing preferential mode, wherein conditions of a printing made for performing printing on an other printing medium can be set by differentiating at least one of the conditions in the cloth printing preferential printing mode in a host computer which generates an image signal, and said at least one of the conditions is a condition related to respectively amounts of black and color inks to be ejected to the unit of the printing medium.

25. A method for producing an ink-jet printed product as claimed in claim 24, wherein the cloth contains a dye fixing agent having a polarity before printing, and the image is instantly fixed simultaneously with printing step.

26. A method for producing an ink-jet printed product as claimed in claim 24, wherein after completion of said printing step on the cloth, stabilizing the printed image is performed by the dye fixing agent having the polarity.

27. A method for producing an ink jet printed product as claimed in claim 24, further comprising the step of, after completion of said printing step on the cloth, fixing the printed image by at least one of a heating process and a wet heating process.

28. A method for producing an ink-jet printing product as claimed in claim 26, further comprising the step of, after said fixing step, washing said cloth.

29. A method for producing an ink jet printed product as claimed in claim 27, further comprising the step, after the washing step, of applying at last one of a cutting process and a sewing process to the cloth.

30. An ink-jet printing apparatus employing an ink head mechanism which can eject a plurality of colors of inks, and performing printing by ejecting inks from said ink-jet head mechanism to a printing medium while said ink-jet head mechanism and said printing medium are moved relatively to each other, comprising:

preferential printing mode being a preferential mode and taking a maximum ink amount to be provided per unit area of a common paper for color ink different from black ink as reference printing condition;

reference cloth printing mode being a mode for printing on a cloth and setting a maximum ink amount at double of said reference printing condition for said color inks and at three times of said reference printing condition for said black ink;

selected cloth printing mode for performing printing under a condition which is set by modifying at least one of the maximum ink amount to be provided in the unit area of the color ink and the black ink in said reference cloth printing mode, depending upon a kind of cloth; and means for setting said selected cloth printing mode in place of said reference cloth printing mode.

31. An ink-jet printing apparatus employing an ink-jet head and performing printing by ejecting an ink to a printing medium from said ink-jet head according to a set printing mode while the ink-jet head and the printing medium are relatively moved, comprising:

a preferential printing mode for performing printing under a reference printing condition on an OHP sheet as preferential mode;

a cloth printing mode for performing printing on the cloth under conditions in which at least one of conditions in the reference printing mode in said preferential printing mode is modified to a condition for higher image quality; and means for setting said preferential printing mode preferentially to said cloth printing mode and for setting said cloth printing mode in place of said preferential printing mode when said cloth printing mode is selected, wherein said at least one of the conditions is a condition related to respective amounts of black and color inks to be ejected onto the unit of the printing medium.

32. An ink-jet printing apparatus employing an ink-jet head and performing printing by ejecting an ink onto a printing medium from said ink-jet head according to a set printing mode while the ink-jet head and the printing medium are relatively moved, comprising:

a preferential printing mode for performing printing under a reference printing condition on a plain sheet as preferential mode;

a cloth printing mode for performing printing on the cloth treated for stiffening to have clark stiffness greater than or equal to 10 and smaller than or equal to 400 and containing a polarized dye fixing agent under conditions in which at least one of conditions in the reference printing mode in said preferential printing mode is modified to a condition for higher image quality with increased ink ejection amount; and means for setting said preferential printing mode preferentially to said cloth printing mode and for setting said cloth printing mode in place of said preferential printing mode when said cloth printing mode is selected, wherein said at least one of the conditions is a condition related to respective amounts of black and color inks to be ejected onto the unit of the printing medium.

33. An ink-jet printing system comprising:

an ink-jet printing apparatus employing an ink-jet head and performing printing by ejecting an ink onto a printing medium from said ink-jet head according to a set printing mode while the ink-jet head and the printing medium are relatively moved, comprising;

a preferential printing mode for performing printing under a reference printing condition on a plain sheet as preferential mode;

a cloth printing mode for performing printing on the cloth treated for stiffening to have clark stiffness greater than or equal to 10 and smaller than or equal to 400 and containing a polarized dye fixing agent under conditions in which at least one of conditions in the reference printing mode in said preferential printing mode is modified to a condition for higher image quality with increased ink election amount; and means for setting said preferential printing mode preferentially to said cloth printing mode and for setting said cloth printing mode in place of said preferential printing mode when said cloth printing mode is selected, wherein said at least one of the conditions is a condition related to respective amounts of black and color inks to be ejected onto the unit of the printing medium; and a host computer connected to the ink-jet printing apparatus and generating an image signal to be printed, on which host computer, the ink ejection amount per unit area for said black ink and said color ink other than black ink can be modified to have the upper limit at less than or equal to four times of the reference printing condition in the preferential printing mode.

* * * * *

UNITED STATES PATENT AND TRADEMARK OFFICE

CERTIFICATE OF CORRECTION

PATENT NO. : 6,705,717 B1
DATED : March 16, 2004
INVENTOR(S) : Miyuki Fujita et al.

It is certified that error appears in the above-identified patent and that said Letters Patent is hereby corrected as shown below:

Column 6,
Line 37, “made” should read -- mode --.

Column 7,
Line 22, “plane” should read -- place --.

Column 9,
Line 51, “to he” should read -- to be --.

Column 10,
Line 4, “drown,” should read -- drawn, --.

Column 12,
Line 3, “view point” should read -- viewpoint --.

Column 14,
Line 64, “aiginate,” should read -- alginate, --.

Column 20,
Line 7, “Accethynol:” should read -- Acethynol: --.

Column 22,
Line 63, “accetylene” should read -- acetylene --.
Line 65, “Accethynol:” should read -- Acethynol: --.

Column 25,
Line 24, “-P03H” should read -- $P0_3H$ --.

Column 28,
Line 5, “18.” should read -- 15. --.

Column 29,
Line 55, “per” should read -- paper --.

Column 30,
Line 42, “soled” should read -- sold --.

Column 33,
Line 8, “fictionally slide,” should read -- frictionally slid, --.
Line 57, “fictionally” should read -- frictionally --.

UNITED STATES PATENT AND TRADEMARK OFFICE

CERTIFICATE OF CORRECTION

PATENT NO. : 6,705,717 B1
DATED : March 16, 2004
INVENTOR(S) : Miyuki Fujita et al.

It is certified that error appears in the above-identified patent and that said Letters Patent is hereby corrected as shown below:

Column 36,
Line 13, “differentiates hygro” should read -- differs hygroscopically --.

Column 38,
Line 62, “wicker” should read -- wider --; and “or” should read -- of --.

Column 43,
Line 40, “cyclc.” should read -- cycle. --.

Column 44,
Line 39, “preliminary” should read -- preliminarily --.

Column 45,
Line 10, “mode” should read -- mode in --.
Line 20, “claim 13,” should read -- claim 15, --.
Line 34, “reciprocating move” should read -- reciprocatively moving. --.
Line 39, “preliminary” should read -- preliminarily --.
Line 55, “respectively” should read -- respective --.

Column 46,
Line 14, “respectively” should read -- respective --.
Line 37, “made” should read -- mode --.
Line 60, “claim 26,” should read -- claim 27, --.
Line 64, “last” should read -- least --.

UNITED STATES PATENT AND TRADEMARK OFFICE

CERTIFICATE OF CORRECTION

PATENT NO. : 6,705,717 B1
DATED : March 16, 2004
INVENTOR(S) : Miyuki Fujita et al.

It is certified that error appears in the above-identified patent and that said Letters Patent is hereby corrected as shown below:

Column 48,
Line 34, "election" should read -- ejection --.

Signed and Sealed this

Fourteenth Day of September, 2004

JON W. DUDAS
*Director of the United States Patent and Trademark Office*